US009962957B2

(12) United States Patent
Kamibayashi et al.

(10) Patent No.: US 9,962,957 B2
(45) Date of Patent: May 8, 2018

(54) LIQUID EJECTING APPARATUS AND LIQUID EJECTING METHOD

(71) Applicant: SEIKO EPSON CORPORATION, Tokyo (JP)

(72) Inventors: Masashi Kamibayashi, Matsumoto (JP); Masako Fukuda, Shiojiri (JP); Hironori Sato, Matsumoto (JP); Takahiro Kanegae, Shiojiri (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/358,432

(22) Filed: Nov. 22, 2016

(65) Prior Publication Data

US 2017/0151810 A1 Jun. 1, 2017

(30) Foreign Application Priority Data

Nov. 27, 2015 (JP) ..... 2015-231895
Nov. 22, 2016 (JP) ..... 2016-226568

(51) Int. Cl.
*B41J 11/00* (2006.01)
*B41J 2/21* (2006.01)

(52) U.S. Cl.
CPC ..... *B41J 11/0015* (2013.01); *B41J 2/2114* (2013.01); *B41J 11/009* (2013.01)

(58) Field of Classification Search
CPC ..... B41J 11/0015; B41J 2/2114; B41J 11/009
See application file for complete search history.

(56) References Cited

U.S. PATENT DOCUMENTS 7,048,356 B2 5/2006 Ishikawa et al.
2014/0210887 A1* 7/2014 Fernandez del Rio ..... B41J 2/2114 347/14

FOREIGN PATENT DOCUMENTS

JP 2005-11915 A 5/2005
JP 2012-254647 A 12/2012
JP 2013-256136 A 12/2013

* cited by examiner

*Primary Examiner* — Henok Legesse
(74) *Attorney, Agent, or Firm* — Workman Nydegger

(57) ABSTRACT

A liquid ejecting apparatus includes a transport mechanism which transports a medium in a first direction; a pre-treatment liquid coating mechanism which coats a pre-treatment liquid on the medium; a liquid ejecting unit which includes a plurality of ink nozzles which eject ink; and a control unit which controls the pre-treatment liquid coating mechanism and the liquid ejecting unit, in which the pre-treatment liquid coating mechanism includes a first mechanism which is disposed in a first region A and a second mechanism which is disposed in a second region B positioned on an upstream side of the first region A in the first direction, and the plurality of ink nozzles has a portion which overlaps with respect to the first mechanism in a second direction which intersects with the first direction and a portion which does not overlap with respect to the second mechanism in the second direction.

10 Claims, 15 Drawing Sheets

| CASE | MEDIUM ABSORBENCY | LANDING TIME DIFFERENCE | IMMEDIATELY AFTER PRE-TREATMENT LIQUID LANDING | IMMEDIATELY BEFORE INK LANDING | SURFACE RESIDUAL AMOUNT | COATING AREA |
|---|---|---|---|---|---|---|
| 1 | HIGH | LARGE |   |   | SMALL | SMALL |
| 2 | HIGH | SMALL |   |   | MEDIUM | MEDIUM |
| 3 | LOW | LARGE |   |   | MEDIUM | LARGE |
| 4 | LOW | SMALL |   |   | LARGE | MEDIUM |

| CASE | MEDIUM ABSORBENCY | LANDING TIME DIFFERENCE | IMMEDIATELY AFTER INK LANDING | AFTER PREDETERMINED TIME ELAPSES |
|---|---|---|---|---|
| 1 | HIGH | LARGE |   |   |
| 2 | HIGH | SMALL |   |   |
| 3 | LOW | LARGE |   |   |
| 4 | LOW | SMALL |   |   |

| CASE | MEDIUM ABSORBENCY | PRE-TREATMENT LIQUID PERMEABILITY | IMMEDIATELY AFTER PRE-TREATMENT LIQUID LANDING | IMMEDIATELY BEFORE INK LANDING | SURFACE RESIDUAL AMOUNT | COATING AREA |
|---|---|---|---|---|---|---|
| 5 | HIGH | HIGH |   |   | SMALL | SMALL |
| 6 | HIGH | LOW |   |   | MEDIUM | MEDIUM |
| 7 | LOW | HIGH |   |   | MEDIUM | LARGE |
| 8 | LOW | LOW |   |   | LARGE | MEDIUM |

| CASE | MEDIUM ABSORBENCY | PRE-TREATMENT LIQUID PERMEABILITY (LANDING ORDER) | IMMEDIATELY BEFORE OVERLAPPING PRE-TREATMENT LIQUID | IMMEDIATELY BEFORE INK LANDING | SURFACE RESIDUAL AMOUNT | COATING AREA |
|---|---|---|---|---|---|---|
| 9 | HIGH | HIGH → LOW |   |   | MEDIUM | MEDIUM |
| 10 | LOW | LOW → HIGH |   |   | MEDIUM | MEDIUM |

| CASE | MEDIUM ABSORBENCY | PRE-TREATMENT LIQUID PERMEABILITY (LANDING ORDER) | IMMEDIATELY AFTER INK LANDING | AFTER PREDETERMINED TIME ELAPSES |
|---|---|---|---|---|
| 9 | HIGH | HIGH → LOW |   |   |
| 10 | LOW | LOW → HIGH |   |   |

LIQUID EJECTING APPARATUS AND LIQUID EJECTING METHOD

The entire disclosure of Japanese Patent Application No. 2015-231895, filed Nov. 27, 2015 and Japanese Patent Application No. 2016-226568, filed Nov. 22, 2016 are expressly incorporated by reference herein.

TECHNICAL FIELD

The present invention relates to a technique for ejecting liquid such as ink onto a medium.

BACKGROUND ART

In ink jet-type liquid ejecting apparatuses, in order to improve the fixation of the ink to a medium, techniques for ejecting a pre-treatment liquid which includes reactive components such as an aggregating agent and an ink using a liquid ejecting head and landing the ink on the medium after landing the pre-treatment liquid so as to react the pre-treatment liquid and the ink on the surface of the medium have been developed. For example, since the ink jet head in PTL 1 is provided with nozzle rows which eject the pre-treatment liquid (reaction liquid) on the upstream side of the nozzle rows which eject ink in the transport direction of the medium, it is possible to land ink on the medium after first landing the pre-treatment liquid.

CITATION LIST

Patent Literature

[PTL 1] JP-A-2013-256136

SUMMARY OF INVENTION

Technical Problem

However, in a case where ink is landed after first landing a pre-treatment liquid as in PTL 1, depending on the type of the medium, the printing quality may be decreased as the landing time difference between the pre-treatment liquid and the ink increases. For example, since the pre-treatment liquid easily permeates into a medium with high liquid absorbency or the like, as the landing time difference between the pre-treatment liquid and the ink is increased, the residual amount of the reaction component on the medium surface decreases due to the pre-treatment liquid landed first permeating into the medium, thus there is a problem in that the reaction amount with the ink landed subsequently decreases, which decreases the printing quality. In particular, as in the ink jet head of PTL 1, in a configuration in which pre-treatment liquid nozzle rows are only provided on the upstream side of the ink nozzle rows in the transport direction of the medium, the landing time difference between the pre-treatment liquid and the ink is easily increased, and the reaction amount with the ink landed subsequently is easily decreased. An advantage of some aspects of the invention is to increase the reactivity between the pre-treatment liquid and the ink and improving the printing quality regardless of the type of medium through a configuration which is able to change the landing time difference between the pre-treatment liquid and the ink.

Solution to Problem

In order to solve the problem, according to an aspect of the invention, there is provided a liquid ejecting apparatus including a transport mechanism which transports a medium in a first direction, a pre-treatment liquid coating mechanism which coats a pre-treatment liquid on the medium, a liquid ejecting unit which includes a plurality of ink nozzles which eject ink, and a control unit which controls the pre-treatment liquid coating mechanism and the liquid ejecting unit, in which the pre-treatment liquid coating mechanism includes a first mechanism which is disposed in a first region and a second mechanism which is disposed in a second region positioned on an upstream side of the first region in the first direction, and the plurality of ink nozzles is formed to have a portion which overlaps with respect to the first mechanism in a second direction which intersects with a first direction and a portion which does not overlap with respect to the second mechanism in the second direction. Since the arrangement of the first mechanism and the plurality of ink nozzles in the above configuration makes it possible to eject inks from a plurality of ink nozzles after coating the pre-treatment liquid on the medium using the first mechanism without transporting the medium in the transport direction, and it is possible to reduce the landing time difference between the pre-treatment liquid and the ink. On the other hand, the arrangement of the second mechanism and the plurality of ink nozzles of the present aspect makes it possible to increase the landing time difference between the pre-treatment liquid and the ink by ejecting inks from the plurality of ink nozzles and by transporting the medium in the transport direction after coating the pre-treatment liquid on the medium using the first mechanism. In this manner, configuring the liquid ejecting apparatus so as to be able to change the landing time difference between the pre-treatment liquid and the ink also makes it possible to change the landing time difference between the pre-treatment liquid and the ink according to the type of medium. Accordingly, regardless of the type of medium, it is possible to increase the reactivity between the pre-treatment liquid and the ink and improve the printing quality.

A preferable aspect of the invention further includes a determination unit for determining a type of medium, in which the control unit selects either the first mechanism or the second mechanism according to the type of medium determined by the determination unit, and the selected mechanism coats the pre-treatment liquid on the medium. According to the above aspect, since the control unit selects either the first mechanism or the second mechanism according to the type of medium determined by the determination unit and ejects the ink after coating the pre-treatment liquid on the medium from the selected mechanism, it is possible to change the landing time difference between the pre-treatment liquid and the ink according to the determined medium type. Accordingly, regardless of the type of medium, it is possible to increase the reactivity between the pre-treatment liquid and the ink and improve the printing quality.

In a preferable aspect of the invention, the first region is further divided into an upstream side region and a downstream side region in the first direction, the plurality of ink nozzles are respectively disposed in the upstream side region and the downstream side region in the first region, the first mechanism is respectively disposed in the upstream side region and the downstream side region in the first region, and the control unit selects either the ink nozzles in the upstream side region in the first region or the ink nozzles in the downstream side region in the first region according to the type of medium determined by the determination unit, and ejects the ink from the selected nozzles. According to the above aspect, not only is it possible to select either of the first mechanism and the second mechanism, but, with regard to the ink nozzles, it is possible to select the nozzles of the upstream side region or the nozzles of the downstream side region in the second region. Accordingly, since the selection combinations of the pre-treatment liquid coating mechanisms and the ink nozzles are increased, the selection options for the landing time difference between the pre-treatment liquid and the ink are also increased, thus it is possible to finely adjust the landing time difference.

In a preferable aspect of the invention, the second region is further divided into an upstream side region and a downstream side region in the first direction, the second mechanism is respectively disposed in the upstream side region and the downstream side region in the second region, and in a case of selecting the second mechanism, the control unit further selects either one or both of the second mechanism in the upstream side region and the second mechanism in the downstream side region in the second region, and ejects the pre-treatment liquid from the selected mechanism. According to the above aspect, for the first mechanism, it is possible to select the mechanism of the upstream side region or the mechanism of the downstream side region in the first region, and, for the second mechanism, it is also possible to select the mechanism of the upstream side region or the mechanism of the downstream side region in the second region. Accordingly, since the selection combinations of the pre-treatment liquid mechanisms and the ink nozzles are increased, the selection options for the landing time difference between the pre-treatment liquid and the ink are also increased, thus it is possible to more finely adjust the landing time difference.

In a preferable aspect of the invention, the pre-treatment liquid is a first pre-treatment liquid and a second pre-treatment liquid which is a different type from the first pre-treatment liquid, the first mechanism includes a nozzle which ejects the first pre-treatment liquid, and the second mechanism includes a nozzle which ejects the second pre-treatment liquid. According to the above aspect, using the first pre-treatment liquid and the second pre-treatment liquid, it is possible to change not only the landing time difference between the pre-treatment liquid and the ink according to the type of medium, but also the type of the pre-treatment liquid to either of the first pre-treatment liquid and the second pre-treatment liquid according to the type of medium.

A preferable aspect of the invention further includes a liquid ejecting head which is provided with a pre-treatment liquid coating mechanism and a liquid ejecting unit, and a movement mechanism which reciprocates the liquid ejecting head in the second direction, in which the liquid ejecting head is provided with plurality of nozzle rows which are arrayed at intervals to each other in the second direction, each of the plurality of the nozzle rows has a plurality of nozzles which are arranged from the first region to the second region, the plurality of the nozzles which are arranged in the first region in one nozzle row out of the plurality of the nozzle rows are used as the first mechanism and the plurality of the nozzles which are arranged in the second region are used as the second mechanism, and the plurality of the nozzles which are arranged in the first region in other nozzle rows out of the plurality of the nozzle rows are used as the plurality of the ink nozzles. According to the above configuration, since some of the nozzles in the plurality of nozzle rows arrayed in the second direction at intervals to each other in the liquid ejecting head are used as the first mechanism, the second mechanism, and the ink nozzles, it is possible to change the arrangement of the pre-treatment liquid and the ink according to the position of the nozzles to be used.

A preferable aspect of the invention further includes a liquid ejecting head which is provided with a pre-treatment liquid coating mechanism and a liquid ejecting unit, and a movement mechanism which reciprocates the liquid ejecting head in the second direction, in which the pre-treatment liquid is a first pre-treatment liquid and a second pre-treatment liquid with higher permeability than the first pre-treatment liquid, the first mechanism includes two nozzle rows which are arrayed at intervals to each other in the second direction, and one of the nozzle rows is formed of nozzles which eject the first pre-treatment liquid and the other nozzle row is formed of nozzles which eject the second pre-treatment liquid, the nozzles which eject the first pre-treatment liquid and the nozzles which eject the second pre-treatment liquid are overlapped with each other in plan view in the second direction, the second mechanism includes two nozzle rows which are arrayed at intervals to each other in the second direction, and one of the nozzle rows is formed of nozzles which eject the first pre-treatment liquid and the other nozzle row is formed of nozzles which eject the second pre-treatment liquid, and the nozzles which eject the first pre-treatment liquid and the nozzles which eject the second pre-treatment liquid are overlapped with each other in plan view in the second direction. According to the above configuration makes it possible to change not only the landing time difference between the pre-treatment liquid and the ink according to the type of medium, but also the order in which the first pre-treatment liquid and the second pre-treatment liquid overlap according to the type of medium, and to stabilize the permeability and wet-spreading property of the pre-treatment liquids regardless of the characteristics of the medium. Due to this, since it is possible to further increase the wet-spreading property of the pre-treatment liquid while increasing the reactivity between the pre-treatment liquid and the ink regardless of the type of medium, it is possible to provide a higher printing quality in comparison with a case of changing only the landing time difference between the pre-treatment liquid and the ink.

In a preferable aspect of the invention, the two nozzle rows in the first mechanism are arranged in order of the nozzle row of nozzles which eject the second pre-treatment liquid and the nozzle row of nozzles which eject the first pre-treatment liquid in the moving direction of the liquid ejecting head, and the two nozzle rows in the second mechanism are arranged in the order of the nozzle row of nozzles which eject the first pre-treatment liquid and the nozzle row of nozzles which eject the second pre-treatment liquid in the moving direction of the liquid ejecting head. According to the above configuration, while moving the liquid ejecting heads in the same direction, it is possible to land the second pre-treatment liquid and the first pre-treatment liquid on the medium in this order when the first mechanism is selected, and it is possible to land first pre-treatment liquid and the second pre-treatment liquid on the medium in this order when the second mechanism is selected. Due to this, when the first pre-treatment liquid and the second pre-treatment liquid are overlapped, it is possible to change the overlapping order of the first pre-treatment liquid and the second pre-treatment liquid even without returning the liquid ejecting head. Accordingly, even when the overlapping order of the first pre-treatment liquid and the second pre-treatment liquid is changed, it is possible to not generate a landing time difference between the first pre-treatment liquid and the second pre-treatment liquid.

A preferable aspect of the invention further includes a transport mechanism which transports the medium in a first direction and a liquid ejecting head which is provided with the pre-treatment liquid coating mechanism and the liquid ejecting unit, in which the liquid ejecting head is a long line head in the second direction intersecting with the first direction. According to the above aspect, even when the liquid ejecting head is a line head, it is possible to change the landing time difference between the pre-treatment liquid and the ink according to the type of medium. Accordingly, regardless of the type of medium, it is possible to increase the reactivity between the pre-treatment liquid and the ink and improve the printing quality.

According to another aspect of the invention, there is provided a liquid ejecting method for a liquid ejecting apparatus, which coats a pre-treatment liquid on a medium and then lands ink on the medium, the liquid ejecting apparatus including a transport mechanism which transports a medium in a first direction, a pre-treatment liquid coating mechanism which coats a pre-treatment liquid on the medium, and a liquid ejecting unit which includes a plurality of ink nozzles which eject ink, in which the pre-treatment liquid coating mechanism includes a first mechanism which is disposed in a first region and a second mechanism which is disposed in a second region positioned on an upstream side of the first region in the first direction, and the plurality of ink nozzles are formed to have a portion which overlaps with respect to the first mechanism in a second direction which intersects with a first direction and a portion which does not overlap with respect to the second mechanism in the second direction, the liquid ejecting method including determining the type of the medium, selecting either the first mechanism or the second mechanism according to the determined type of the medium, and coating the pre-treatment liquid on the medium using the selected mechanism. According to the above configuration makes it possible to change the landing time difference between the pre-treatment liquid and the ink according to the type of medium. Accordingly, regardless of the type of medium, it is possible to increase the reactivity between the pre-treatment liquid and the ink and improve the printing quality.

DESCRIPTION OF EMBODIMENTS

First Embodiment

Figure 1:
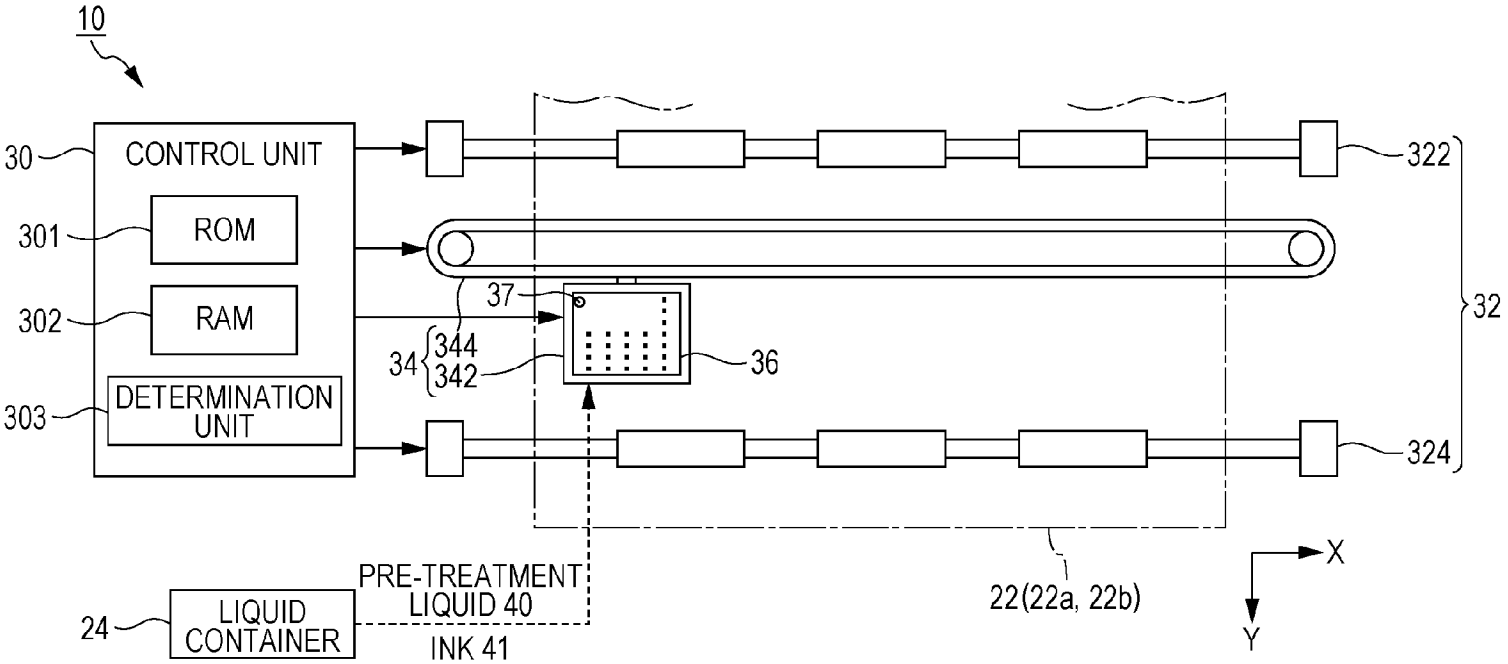
FIG. 1 is a configuration diagram of a liquid ejecting apparatus according to a first embodiment.

FIG. 1 is a configuration diagram of a liquid ejecting apparatus 10 according to a first embodiment of the invention. The liquid ejecting apparatus 10 is a printing apparatus (an ink jet apparatus) for printing an image on a surface of a medium 22 by ejecting an ink 41 which is an example liquid on the medium 22. The medium 22 is a medium for recording, such as printing paper or films, which is the ejection target of the ink 41. Detailed description will be given below of types of media used in the first embodiment.

A liquid container 24 which stores liquid is mounted on the liquid ejecting apparatus 10 and the liquid container 24 stores a pre-treatment liquid 40 and the ink 41. The ink 41 is a liquid (a color ink) which contains coloring materials such as pigments or dyes. A total of four colors of the ink 41, for example, cyan (C), magenta (M), yellow (Y), and black (K) are stored in the liquid container 24. It is also possible for the ink 41 to contain a resin material.

The pre-treatment liquid 40 is a liquid (an optimizer ink) for improving the fixation of the ink 41 which lands on the surface of the medium 22 and contains, for example, a reaction component such as aggregating agents which react with the ink 41 and a solution component such as water or solvents. The pre-treatment liquid 40 does not contain the coloring material or resin material included in the ink 41. The pre-treatment liquid 40 may contain a surfactant. FIG. 1 illustrates the liquid container 24 as one element for convenience; however, it is also possible to adopt a configuration in which the pre-treatment liquid 40 and a plurality of types of the ink 41 are stored in a separate liquid container 24, or a configuration in which each of the plurality of types of the ink 41 are stored in a separate liquid container 24.

The liquid ejecting apparatus 10 is provided with a control unit 30, a transport mechanism 32, a movement mechanism 34, and a liquid ejecting head 36. The control unit 30 is provided with, for example, a control circuit such as a central processing unit (CPU) or a field programmable gate array (FPGA), a read only memory (ROM) 301, a random access memory (RAM) 302, and a determination unit 303 which determines the type of the medium 22. The ROM 301 is, for example, a rewritable flash ROM. Programs executed by the control unit 30 and various items of data (medium data tables and the like which will be described below) required for execution of the programs are stored in the ROM 301. Data or the like which is temporarily used when the control unit 30 executes the programs is stored in the RAM 302. A management apparatus (not shown) such as a personal computer is connected to the control unit 30. The control unit 30 integrally controls each element of the liquid ejecting apparatus 10 according to instructions from the management apparatus. The determination unit 303 determines the type of the medium 22 based on the medium data tables described above. Detailed description will be given below regarding the determination of the type of the medium 22.

The transport mechanism 32 transports the medium 22 in the Y direction (illustrated as the first direction) under the control of the control unit 30. The transport mechanism 32 of the first embodiment includes a supply roller 322 and a discharge roller 324. The supply roller 322 is disposed on the upstream side (the negative side in the Y direction) of the discharge roller 324 and transports the medium 22 to the discharge roller 324 side, and the discharge roller 324 transports the medium 22 supplied from the supply roller 322 to the downstream side (the positive side in the Y direction). It should be noted that the configuration of the transport mechanism 32 is not limited to the above example.

The movement mechanism 34 is a mechanism which reciprocates the liquid ejecting head 36 in the X direction under the control of the control unit 30. The X direction in which the liquid ejecting head 36 reciprocates is the direction which intersects (typically, which is orthogonal thereto) the Y direction in which the medium 22 is transported. The movement mechanism 34 is provided with a carriage 342 and a conveyor belt 344. The carriage 342 has a substantially box-shaped structure which supports the liquid ejecting head 36, and is fixed to the conveyor belt 344. The conveyor belt 344 is an endless belt installed in the X direction. The liquid ejecting head 36 reciprocates in the X direction together with the carriage 342 due to the conveyor belt 344 being rotated under the control of the control unit 30. It should be noted that the configuration of the movement mechanism 34 is not limited to the above example. It is also possible, for example, to mount the liquid container 24 on the carriage 342 with the liquid ejecting head 36.

The liquid ejecting head 36 ejects the pre-treatment liquid 40 and the ink 41 supplied from the liquid container 24 onto the medium 22 under the control of the control unit 30. In parallel with the transport of the medium 22 by the transport mechanism 32 and the reciprocating motion by the movement mechanism 34, a desired image is formed on the surface of the medium 22 by the liquid ejecting head 36 ejecting the pre-treatment liquid 40 and the ink 41 onto the medium 22.

(Configuration Example of Liquid Ejecting Head)

Figure 2:
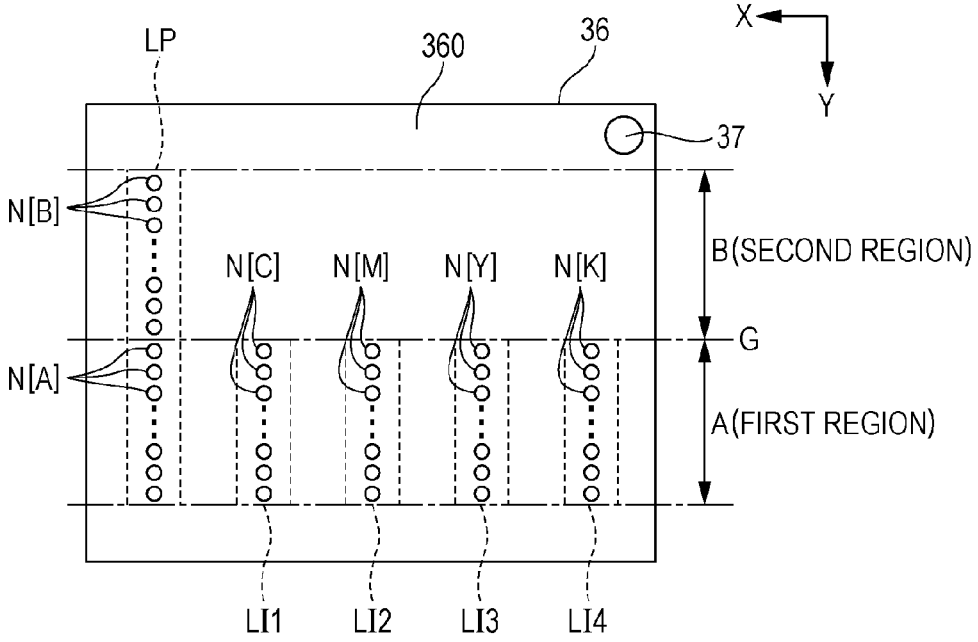
FIG. 2 is a plan view of an ejection surface of a liquid ejecting head.

The liquid ejecting head 36 of the first embodiment is formed to be able to change the landing time difference between the pre-treatment liquid 40 and the ink 41 with respect to the medium 22. FIG. 2 shows the specific configuration example of the liquid ejecting head 36. FIG. 2 is a plan view of the surface (referred to below as "an ejection surface") 360 of the liquid ejecting head 36 opposed to the medium 22. One pre-treatment liquid nozzle row LP and four ink nozzle rows LI1 to LI4 are disposed on the ejection surface 360 of the liquid ejecting head 36 shown in FIG. 2. The pre-treatment liquid nozzle row LP and each of the ink nozzle rows LI1 to LI4 are a set of a plurality of nozzles N arrayed in a linear form in the Y direction. Here, it is possible to set the pre-treatment liquid nozzle row LP1 and each of the ink nozzle rows LI1 to LI4 as a plurality of rows (for example, a zig-zag array or a staggered array).

For example, when a straight line G parallel to the X direction is assumed to be the ejection surface 360, the liquid ejecting head 36 shown in FIG. 2 is divided into a first region A which is the positive side (the downstream side in the transport direction of the medium 22) of the straight line G in the Y direction and a second region B which is the negative side (the upstream side in the transport direction of the medium 22) of the straight line G in the Y direction. The pre-treatment liquid nozzle rows LP are arranged from the first region A to the second region B and the ink nozzle rows LI1 to LI4 are arranged in the first region A.

The pre-treatment liquid nozzle rows LP include a plurality of first region nozzles N[A] arranged in the first region A and a plurality of second region nozzles N[B] arranged in the second region B. The first region nozzles N[A] and the second region nozzles N[B] are able to eject the pre-treatment liquid 40 supplied separately from the liquid container 24. On the other hand, each of the nozzles N[C], N[M], N[Y], and N[K] of the ink nozzle rows LI1 to LI4 ejects the inks 41 of different colors, that is, the inks 41 of four colors of cyan(C), magenta(M), yellow(Y), and black (K). Each of the ink nozzle rows LI1 to LI4 is arrayed at intervals to each other in the X direction.

In the liquid ejecting head 36 in FIG. 2, the range in which the plurality of the first region nozzles N[A] are distributed in the X direction overlaps with the range in which the nozzles N[C], N[M], N[Y], and N[K] of the ink nozzle rows LI1 to LI4 are distributed in the X direction, while the range in which the plurality of the second region nozzles N[B] are distributed in the X direction does not overlap the range in which the nozzles N[C], N[M], N[Y], and N[K] of the ink nozzle rows LI1 to LI4 are distributed in the X direction, and is on the upstream side in the transport direction (the Y direction) of the medium 22. Accordingly, a plurality of the first region nozzles N[A] are formed substantially at the same positions as the ink nozzle rows LI1 to LI4 in the transport direction (the Y direction) of the medium 22 and a plurality of the second region nozzles N[B] are formed in positions separated to the upstream side as seen from ink nozzle rows LI1 to LI4 in the transport direction (the Y direction).

With the liquid ejecting head 36 with such a configuration, ejecting the pre-treatment liquid 40 by selecting either the first region nozzles N[A] or the second region nozzles N[B] makes it possible to subsequently change the landing time difference with the ink 41 to be landed on the medium 22 by being ejected from the nozzles N[C], N[M], N[Y], and N[K] of the ink nozzle rows LI1 to LI4.

Figure 3:
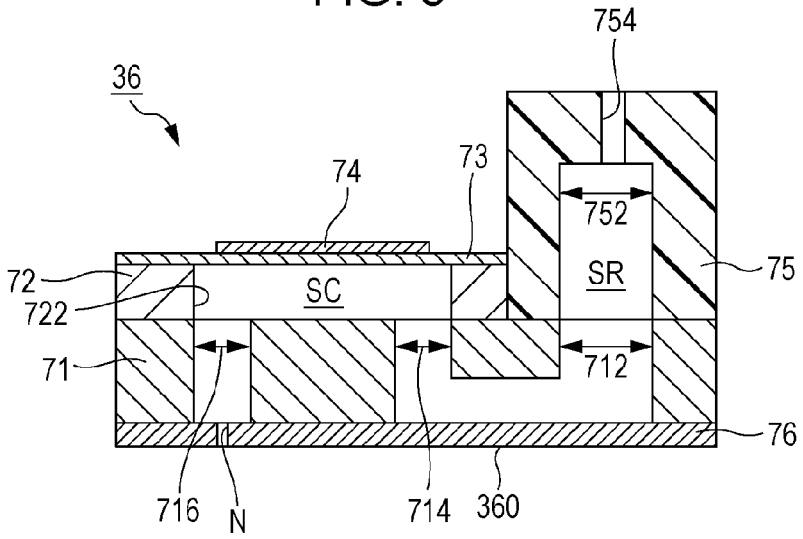
FIG. 3 is a cross-sectional view of the liquid ejecting head.

FIG. 3 is a cross-sectional view focusing on one arbitrary nozzle N in the liquid ejecting head 36. As illustrated in FIG. 3, the liquid ejecting head 36 has a structure in which a pressure chamber substrate 72, a vibration plate 73, a piezoelectric element 74, and a support 75 are disposed on one side of a flow path substrate 71, and a nozzle plate 76 is disposed on the other side. The flow path substrate 71, the pressure chamber substrate 72, and the nozzle plate 76 are formed of, for example, a flat silicon plate and the support 75 is formed by, for example, injection molding a resin material. A plurality of nozzles N is formed on the nozzle plate 76.

An opening 712, a branch flow path (a diaphragm flow path) 714, and a communication flow path 716 are formed on the flow path substrate 71. The branch flow path 714 and the communication flow path 716 are through holes formed for every nozzle N and the opening 712 is an opening which is continuous over a plurality of the nozzles N. A space in which a housing portion (a recess portion) 752 formed in the support 75 and the opening 712 of the flow path substrate 71 communicate with each other functions as a common liquid chamber (a reservoir) SR which stores the pre-treatment liquid 40 or the ink 41 supplied from the liquid container 24 via an introduction flow path 754 of the support 75.

Openings 722 are formed in every nozzle N in the pressure chamber substrate 72. The vibration plate 73 is an elastically deformable flat plate disposed on a surface of a side opposing the flow path substrate 71 on the pressure chamber substrate 72. A space between the vibration plate 73 and the flow path substrate 71 inside each of the openings 722 in the pressure chamber substrate 72 functions as a pressure chamber (a cavity) SC filled with the pre-treatment liquid 40 or the ink 41 supplied via the branch flow path 714 from the common liquid chamber SR. Each of the pressure chambers SC communicates with the nozzles N via the communication flow path 716 of the flow path substrate 71.

The piezoelectric elements 74 are formed for each of the nozzles N on the surface of the side opposing the pressure chamber substrate 72 in the vibration plate 73. Each of the piezoelectric elements 74 is a driving element which interposes a piezoelectric body between electrodes which oppose each other. When the vibration plate 73 vibrates due to the piezoelectric element 74 being deformed due to the supply of a driving signal, the pressure in the pressure chamber SC changes and the ink 41 in the pressure chamber SC is ejected from the nozzles N.

Each of the ink nozzle rows LI1 to LI4 in FIG. 2 may be arranged in each independent liquid ejecting head 36 respectively and each of the liquid ejecting heads 36 may be mounted in separate carriages 342. In such a case, one or plurality of liquid ejecting heads 36 for ejecting one color ink or two or more color inks may be mounted on one the carriages 342. In such a case, it is also possible to form the liquid ejecting heads 36 including nozzles which eject the pre-treatment liquids 40 independently and mount the liquid ejecting heads 36 on separate carriages 342. In this manner, by separating the carriages 342, it is easier to adjust the timing for landing the pre-treatment liquid 40 on the medium 22 and the timing for landing the ink 41 on the medium 22.

(Determination of Type of Medium)

The determination unit 303 of the control unit 30 of the first embodiment determines the type of the medium 22. Specifically, the determination unit 303 determines a medium 22*a* with high liquid absorbency or a medium 22*b* with low liquid absorbency. Examples of the medium 22*a* with high liquid absorbency include plain paper and ink jet paper, as well as coated media and the like. Examples of the medium 22*b* with low liquid absorbency include plastic films such as polyvinyl chloride (PVC), polyethylene terephthalate (PET), and polycarbonate (PC), films in which plastic or a receptive layer is coated on a substrate, metal, printed wiring substrates, fabrics, and the like. Here, the absorbency of the fabric may vary depending on the fibers which form the fabric. The fabric here is included as the medium 22*b* with low liquid absorbency assuming a case of being formed of fibers with low absorbency; however, the fabric is not limited thereto and fabrics formed of fibers with high absorbency may be included as the medium 22*a* with high liquid absorbency.

For example, a medium data table formed of a group the listing the media 22*a* with high liquid absorbency and a group listing the media 22*b* with low liquid absorbency is stored in the ROM 301 in advance. The type of the medium 22 is able to be selected by a user from an operation unit (not shown) connected to the control unit 30. The determination unit 303 determines the medium 22*a* with high liquid absorbency or the medium 22*b* with low liquid absorbency according to whichever group in the medium data table includes the medium 22 selected by the user.

The method for determining the type of the medium 22 is not limited to the case described above. The determination unit 303, for example, may determine the type of the medium 22 based on a detection signal from a medium sensor 37 shown in FIG. 2. The medium sensor 37 is connected to the control unit 30. The medium sensor 37, for example, is formed of an optical sensor and detects reflected light by irradiating the medium 22 with light. The determination unit 303 determines the medium 22*a* with high liquid absorbency or the medium 22*b* with low liquid absorbency depending on whether or not the detection signal from the medium sensor 37 exceeds a predetermined threshold.

For example, since the reflection intensity of light varies depending on the type of the medium 22, it is possible to set the predetermined threshold as the threshold of the reflection intensity of light for the medium 22 for which it is possible to determine whether the liquid absorbency is high or low according to the reflection intensity of light. In particular, with the plurality of the media 22 where the liquid absorbency is lower as the reflection intensity of light is higher, the medium is determined as the medium 22*a* with high liquid absorbency in a case where the detection signal from the medium sensor 37 does not exceed the predetermined threshold, and the medium is determined as the medium 22*b* with low liquid absorbency in a case where the detection signal exceeds the threshold. It should be noted that the medium sensor 37 need not be provided in a case where the type of the medium 22 is determined according to the selection of the medium 22 by the user as described above.

In the first embodiment, the determination of the type of the medium 22 is carried out as described above, either the plurality of the first region nozzles N[A] or the plurality of the second region nozzles N[B] is selected according to the type of the determined medium, the pre-treatment liquid 40 is ejected and landed on the medium 22, and the landing time difference with the ink 41 to be landed subsequently is changed. According to the above, regardless of the type of medium, it is possible to increase the reactivity between the pre-treatment liquid 40 and the ink 41 and improve the printing quality.

(Relationship Between Type of Medium and Landing Time Difference Between Pre-Treatment Liquid and Ink)

Figure 4:
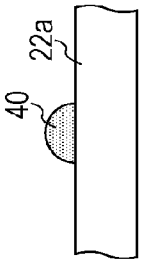
FIG. 4 is a diagram for illustrating a state of a pre-treatment liquid in a case of changing a landing time difference between the pre-treatment liquid and ink with respect to different types of media.
Figure 4:
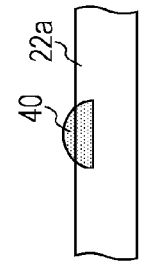
Figure 4:
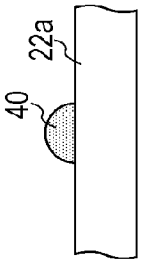
Figure 4:
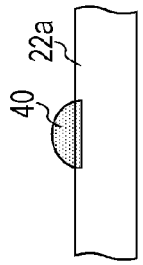
Figure 4:
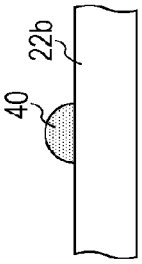
Figure 4:
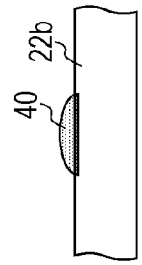
Figure 4:
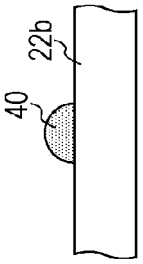
Figure 4:
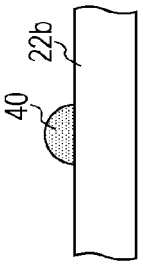
Figure 5:
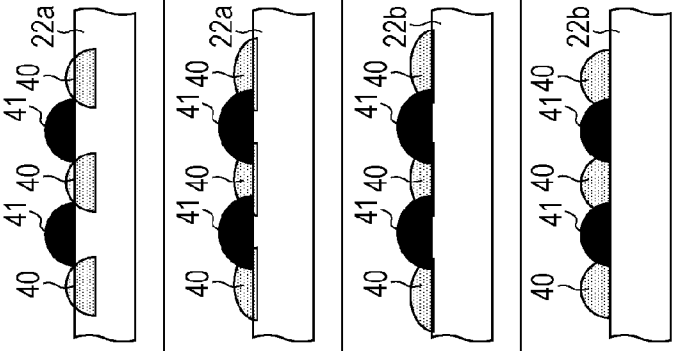
FIG. 5 is a diagram for illustrating a state of ink after ink landing in FIG. 4.
Figure 5:
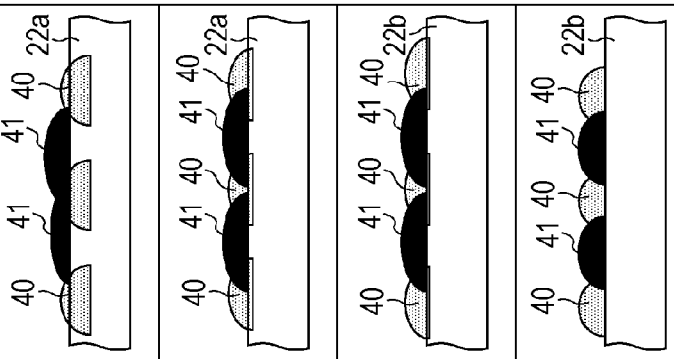

Here, description will be given of the relationship between the type of medium and the landing time difference between the pre-treatment liquid 40 and the ink 41. FIG. 4 is a diagram for illustrating a state of the pre-treatment liquid 40 in four cases 1 to 4 where the landing time difference between the pre-treatment liquid 40 and the ink 41 is changed with respect to different types of media. Here, the different types of the media 22 are either the medium 22*a* with high liquid absorbency (for example, coated paper having an ink absorbing layer) or the medium 22*b* with low liquid absorbency (for example, plastic films such as vinyl chloride). The landing time difference in FIG. 4 and FIG. 5 is the landing time difference between the pre-treatment liquid 40 and the ink 41 in a case where the ink 41 is landed after the pre-treatment liquid 40 is landed.

In FIG. 4, in a case where the pre-treatment liquid 40 is landed on the medium 22*a* with high absorbency, case 1 is a case where the landing time difference with the ink 41 is large and case 2 is a case where the landing time difference with the ink 41 is small. In a case where the pre-treatment liquid 40 is landed on the medium 22*b* with low absorbency, case 3 is a case where the landing time difference with the ink 41 is large and case 4 is a case where the landing time difference with the ink 41 is small. FIG. 5 is a diagram for illustrating the state of the ink 41 after the ink lands in cases 1 to 4 in FIG. 4. The black covered portion is the ink 41 in FIG. 5.

The surface residual amount in FIG. 4 means the residual amount of the pre-treatment liquid 40 remaining on the surface of the medium 22*a* or 22*b* immediately before the ink landing. The greater the degree of permeation (permeability) of the pre-treatment liquid 40 from the surface to the inside of the medium 22*a* or 22*b*, the smaller the surface residual amount of the pre-treatment liquid 40 becomes. The coating area in FIG. 4 is the area of the medium 22*a* or 22*b* coated with residual pre-treatment liquid 40 on the surface of the medium 22*a* or 22*b* immediately before the ink landing. The greater the degree of wet-spreading (wet-spreading property) of the pre-treatment liquid 40 on the surface of the medium 22*a* or 22*b*, the larger the pre-treatment liquid 40 coating area becomes. In FIG. 4, a case where the surface residual amount is large is referred to as "large", a case where the surface residual amount is small is referred to as "small", a case where the coating area is large is referred to as "large", a case where the coating area is small is referred to as "small", and cases where the surface residual amount and the coating area are moderate are referred to as "medium".

First, description will be given of the medium 22*a* with high absorbency in case 1 and case 2 in FIG. 4. In a case where the pre-treatment liquid 40 is landed on the medium 22*a* with high absorbency, when the landing time difference is large as shown in case 1 in FIG. 4, the surface residual amount of the pre-treatment liquid 40 is "small" and the coating area is also "small" immediately before the ink landing, while, when the landing time difference is small as shown in case 2 FIG. 4, both the surface residual amount and the coating area of the pre-treatment liquid 40 are "medium" immediately before the ink landing.

That is, since the pre-treatment liquid 40 easily permeates the medium 22*a* with high absorbency, when the landing time difference between the pre-treatment liquid 40 and the ink 41 is large, the pre-treatment liquid 40 permeates excessively up to immediately before the ink 41 lands as shown in case 1 in FIG. 4, thus the surface residual amount of the pre-treatment liquid 40 is excessively small immediately before the ink landing and the coating area is also small. In such a case, when the ink 41 lands as shown in case 1 in FIG. 5, since the reactivity between the pre-treatment liquid 40 and the ink 41 decreases, dots landed on the surface of the medium 22*a* spread and aggregate easily to overlap each other and there is a concern that the printing quality will decrease.

On the other hand, when the landing time difference is small as shown in case 2 in FIG. 4, it is possible to carry out the reaction with the ink 41 before the pre-treatment liquid 40 permeates excessively. In such a case, since the surface residual amount and the coating area of the pre-treatment liquid 40 are "medium" immediately before the ink landing as in case 2 shown in FIG. 4, it is also possible to improve the reactivity with the ink 41 when the ink 41 is landed as shown in case 2 in FIG. 5, and it is possible to improve the printing quality due to the ink 41 not easily condensing.

Next, description will be given of the medium 22*b* with low absorbency in case 3 and case 4 in FIG. 4. In a case where the pre-treatment liquid 40 lands on the medium 22*b* with low absorbency, when the landing time difference is small as shown in case 4 in FIG. 4, the surface residual amount of the pre-treatment liquid 40 is "large" and the coating area is "medium", while, when the landing time difference is large as shown in case 3 in FIG. 4, the surface residual amount of the pre-treatment liquid 40 is "medium" and the coating area is "large".

That is, since the pre-treatment liquid 40 does not easily permeate the medium 22*b* with low absorbency, when the landing time difference is small as shown in case 4 in FIG. 4, the surface residual amount of the pre-treatment liquid 40 is increased and the ink 41 does not easily condense. However, when the landing time difference is small, since the drying is not completed in time, the surface residual amount of the pre-treatment liquid 40 is excessively large up to immediately before the ink landing, and the drying time for solution components such as water and solvents is also short, the drying tends to be insufficient. In such a case, when the ink 41 is landed as shown in case 4 in FIG. 5, if the drying of the pre-treatment liquid 40 is insufficient, the reactivity between the pre-treatment liquid 40 and the ink 41 decreases, and there is a concern that the printing quality will decrease.

On the other hand, when the landing time difference is large as shown in case 3 in FIG. 4, it is also possible to increase the drying time of a large amount of pre-treatment liquid 40 remaining on the surface of the medium 22*b*. In such a case, when the ink 41 is landed as shown in case 3 in FIG. 5, it is possible to improve the reactivity with the ink 41 and it is possible to improve the printing quality.

In this manner, to improve the printing quality, it is understood that it is preferable to reduce the landing time difference between the pre-treatment liquid 40 and the ink 41 on the medium 22*a* with high absorbency, while it is preferable to increase the landing time difference between the pre-treatment liquid 40 and the ink 41 on the medium 22*b* with low absorbency.

(Liquid Ejecting Method of First Embodiment)

Figure 6:
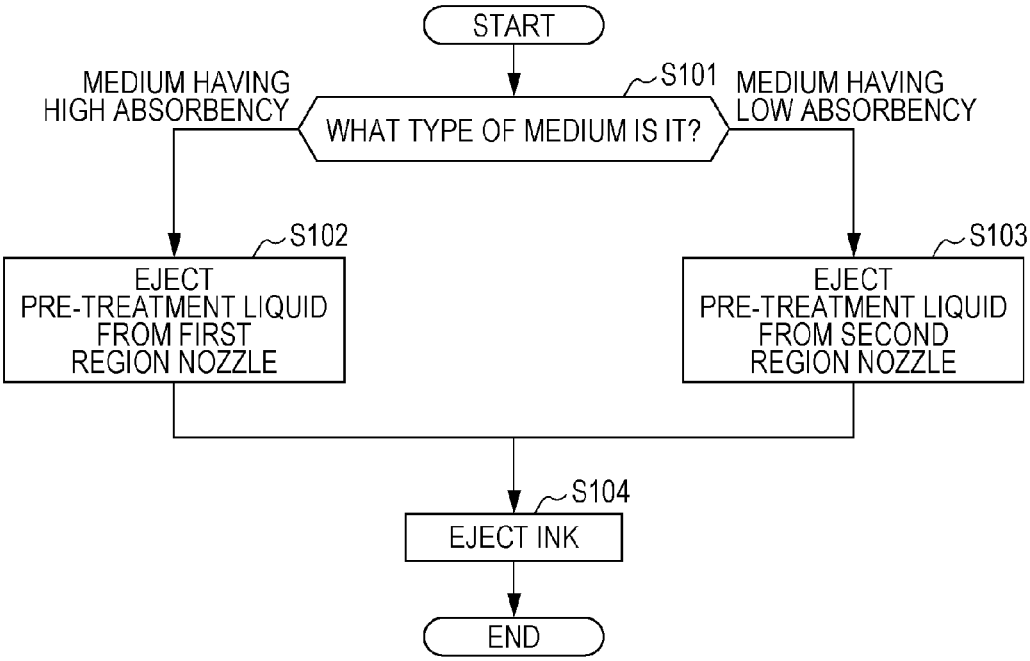
FIG. 6 is a flowchart which shows control of the liquid ejecting head according to the first embodiment.

Based on the above, description will be given of a liquid ejecting method according to the first embodiment by exemplifying control of the liquid ejecting head 36 according to the first embodiment. FIG. 6 is a flow chart which shows the control of the liquid ejecting head 36 in the printing control. The control unit 30 reads a predetermined program from the ROM 301 according to an instruction from the management apparatus and carries out the printing control on the medium 22. In the printing control, the control unit 30 controls the liquid ejecting head 36 shown in FIG. 6 while carrying out transport control of the medium 22.

First, in step S101, the determination unit 303 determines the type of the medium 22 to be printed upon. The determination unit 303 determines the type of the medium 22, for example, based on the medium data table described above. Specifically, the determination unit 303 checks the medium 22 selected by the user against the media 22 in the medium data table, and determines whether the medium 22 is the medium 22*a* with high absorbency or the medium 22*b* with low absorbency. In step S101, the medium 22 may be determined based on the detection signal from the medium sensor 37 as described above.

In step S101, in a case where the determination unit 303 determines the medium 22*a* with high absorbency, in step S102, the control unit 30 ejects the pre-treatment liquid 40 by selecting the first region nozzles N[A] in the pre-treatment liquid nozzle rows LP, while moving the carriage 342 forward. In step S104, the control unit 30 ejects the ink 41 of the required colors from the nozzles N[C], N[M], N[Y], and N[K] in the ink nozzle rows LI1 to LI4 in the portion where the pre-treatment liquid 40 landed while moving the carriage 342 backward without transporting the medium 22*a* in the Y direction, and lands the ink 41 on the medium 22*a*.

In contrast, in a case where the determination unit 303 determines the medium 22*b* with low absorbency in step S101, in step S103, the control unit 30 ejects the pre-treatment liquid 40 by selecting the second region nozzles N[B] in the pre-treatment liquid nozzle rows LP, while moving the carriage 342 forward. In step S104, the control unit 30 ejects the ink 41 of the required colors from the nozzles N[C], N[M], N[Y], and N[K] in the ink nozzle rows LI1 to LI4 on the portion where the pre-treatment liquid 40 landed after transporting the medium 22*b* in the Y direction and lands the ink 41 on the medium 22*b*.

According to the printing control of the first embodiment, in a case where the pre-treatment liquid 40 was ejected by selecting the first region nozzles N[A], since it is not necessary to transport the medium 22 in the Y direction to land the ink 41 on the portion of the medium 22 where the pre-treatment liquid 40 landed, it is possible to reduce the landing time difference between the pre-treatment liquid 40 and the ink 41 compared to a case where the second region nozzles N[B] are selected in which it is necessary to transport the medium 22 in the Y direction.

Accordingly, with respect to the medium 22*a* with high absorbency, since it is possible to reduce the landing time difference between the pre-treatment liquid 40 and the ink 41 as shown in case 2 in FIG. 4 by selecting the first region nozzles N[A], it is possible to improve the reactivity with the ink 41 as shown in case 2 in FIG. 5 and it is possible to improve the printing quality. On the other hand, with respect to the medium 22*b* with low absorbency, since it is possible to increase the landing time difference between the pre-treatment liquid 40 and the ink 41 as shown in case 3 in FIG. 4 by selecting the second region nozzles N[B], it is also possible to improve the reactivity with the ink 41 as shown in case 3 in FIG. 5 and it is possible to improve the printing quality.

Above, description was given in which, in a case of the medium 22*a* with high absorbency, the pre-treatment liquid 40 is ejected from the first region nozzles N[A] when the carriage 342 is moving forward (step S102), and the ink 41 is ejected from the ink nozzle rows LI1 to LI4 when the carriage 342 is moving backward (step S104); however, the invention is not limited thereto. For example, in a case of the medium 22*a* with high absorbency, both the pre-treatment liquid 40 and the ink 41 may be ejected when the carriage 342 is moving forward. That is, in the liquid ejecting head 36 in FIG. 2, since the first region nozzles N[A] are disposed in the same first region A so as to overlap the ink nozzle rows LI1 to LI4 in the X direction in a plan view, it is possible to eject both the pre-treatment liquid 40 and the ink 41 when the carriage 342 is moving forward. Due to this, it is also possible to land the pre-treatment liquid 40 and the ink 41 almost simultaneously on the medium 22 with little time difference.

First Modification Example of First Embodiment

Figure 7:
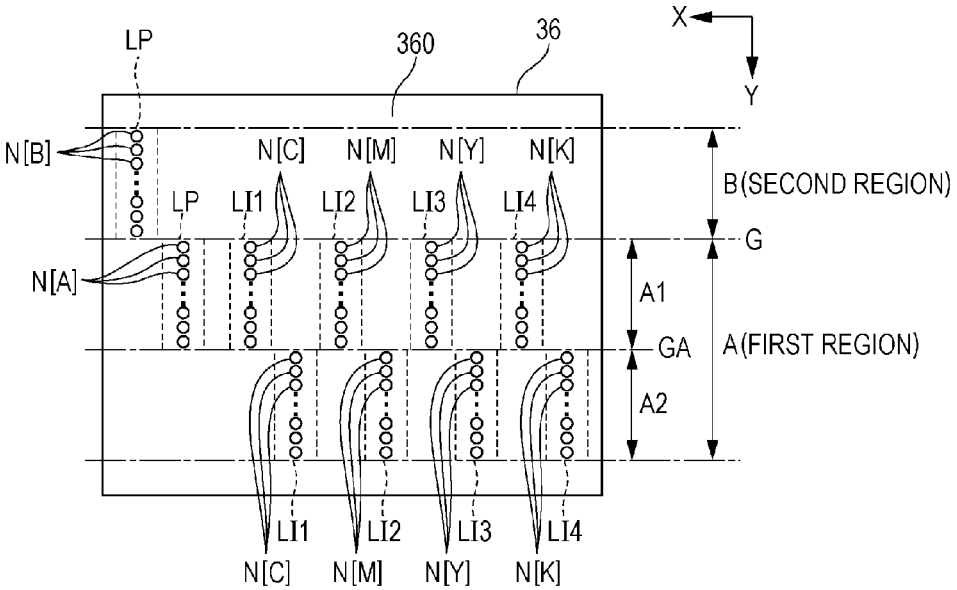
FIG. 7 is a plan view of the ejection surface of the liquid ejecting head according to a first modification example of the first embodiment.

Description will be given of the liquid ejecting head 36 according to a first modification example of the first embodiment. FIG. 7 is a plan view of the ejection surface 360 of the liquid ejecting head 36 according to the first modification example of the first embodiment. The liquid ejecting head 36 in FIG. 7 is different from FIG. 2 in that the first region A of the liquid ejecting head 36 is further divided into a region A1 on the upstream side in the Y direction (the transport direction of the medium 22) and a region A2 on the downstream side. For example, assuming a straight line GA parallel to the X direction in the first region A of the ejection surface 360, the upstream side of the straight line GA in the Y direction is the region A1 and the downstream side of the straight line GA in the Y direction is the region A2.

In the configuration in FIG. 7, the nozzles N[C], N[M], N[Y] and N[K] in the ink nozzle rows LI1 to LI4 are each arranged in the region A1 on the upstream side and in the region A2 on the downstream side in the first region A. The first region nozzles N[A] are arranged in the region A1 on the upstream side in the first region A and the second region nozzles N[B] are arranged in the second region B. As shown in FIG. 7, the nozzles N[C], N[M], N[Y], and N[K] in the ink nozzle rows LI1 to LI4 in the region A1 on the upstream side in the first region A and in the region A2 on the downstream side may be arranged to be shifted in the X direction. In addition, the first region nozzles N[A] and the second region nozzles N[B] may be arranged to be shifted in the X direction.

In the configuration in FIG. 7, the range in which plurality of the first region nozzles N[A] are distributed in the X direction overlaps the range in which ink nozzle rows LI1 to LI4 in the region A1 on the upstream side in the first region A are distributed in the X direction, and the range in which plurality of the second region nozzles N[B] are distributed in the X direction is on the upstream side and does not overlap either of the ranges in which ink nozzle rows LI1 to LI4 in the region A1 or the region A2 in the first region A are distributed in the X direction.

In the printing control of the liquid ejecting head 36 in FIG. 7, the control unit 30 ejects the pre-treatment liquid 40 by selecting either the first region nozzles N[A] or the second region nozzles N[B] according to the type of the medium 22, and ejects the ink 41 from selected nozzles by also selecting either the nozzles of the region A1 on the upstream side or nozzles of the region A2 on the downstream side of the first region A for the nozzles N[C], N[M], N[Y], and N[K]. For example, in a case of selecting the first region nozzles N[A], a case of selecting the ink nozzle rows LI1 to LI4 of the region A1, and a case of selecting the ink nozzle rows LI1 to LI4 of the region A2, selecting the ink nozzle rows LI1 to LI4 of the region A2 makes it possible to slightly increase the landing time difference between the pre-treatment liquid 40 and the ink 41. In addition, even in a case where the second region nozzles N[B] are selected, in a case of selecting the ink nozzle rows LI1 to LI4 of the region A1 and a case of selecting the ink nozzle rows LI1 to LI4 of the region A2, selecting the ink nozzle rows LI1 to LI4 of the region A2 makes it possible to further increase the landing time difference between the pre-treatment liquid 40 and the ink 41.

In this manner, according to the configuration in FIG. 7, for the pre-treatment liquid nozzle row LP, not only it is possible to select either of the first region nozzles N[A] and the second region nozzles N[B], but it is also possible to select the nozzles of the region A1 and the nozzles of the region A2 for the ink nozzle rows LI1 to LI4. Accordingly, since the combinations of nozzle selections for the pre-treatment liquid 40 and the ink 41 are increased, the selection options for the landing time difference between the pre-treatment liquid 40 and the ink 41 are also increased, thus it is possible to finely adjust the landing time difference. In the liquid ejecting head 36 shown in FIG. 7, the case where the first region nozzles N[A] are arranged in the region A1 on the upstream side of the first region A in the pre-treatment liquid nozzle rows LP is exemplified; however, the first region nozzles N[A] may be arranged in the region A2 on the downstream side in the first region A, or the first region nozzles N[A] may be arranged in both the region A1 on the upstream side and the region A2 on the downstream side in the first region A.

Second Modification Example of First Embodiment

Figure 8:
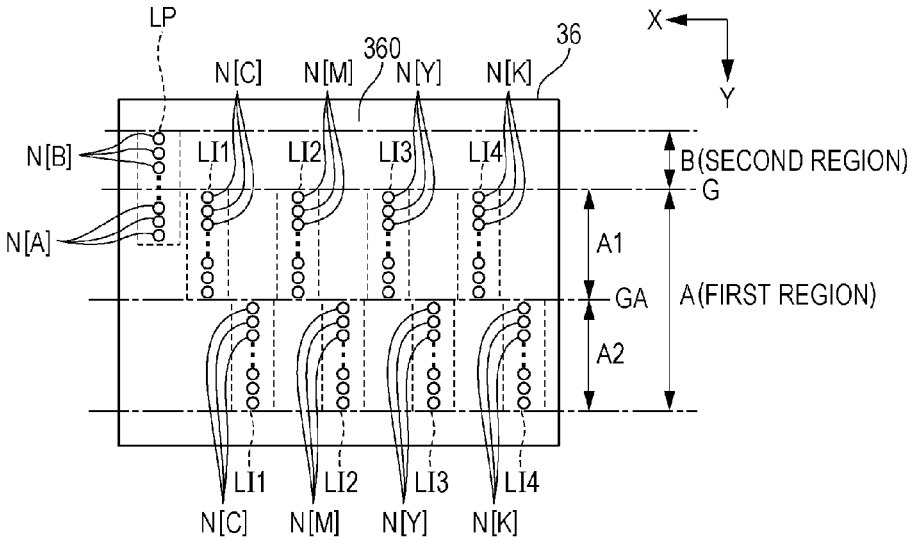
FIG. 8 is a plan view of the ejection surface of the liquid ejecting head according to a second modification example of the first embodiment.

Description will be given of the liquid ejecting head 36 according to a second modification example of the first embodiment. FIG. 8 is a plan view of the ejection surface 360 of the liquid ejecting head 36 according to the second modification example of the first embodiment. In the configuration in FIG. 7, in the region A1 on the upstream side of the first region A, a case where the range in which the first region nozzles N[A] are distributed in the X direction overlaps entirely with the range in which the nozzles N[C], N[M], N[Y], and N[K] are distributed in the X direction is exemplified; however, the invention is not limited thereto. As shown in FIG. 8, in the region A1 on the upstream side of the first region A, the range in which the first region nozzles N[A] are distributed in the X direction may overlap partially with the range in which the nozzles N[C], N[M], N[Y], and N[K] are distributed in the X direction.

The configuration in FIG. 8 exemplifies a case where the range in which the first region nozzles N[A] are distributed in the X direction is set to half of the range in which the nozzles N[C], N[M], N[Y], and N[K] of the region A1 on the upstream side of the first region A are distributed in the X direction. In such a case, as shown in FIG. 8, the range in which the second region nozzles N[B] are distributed in the X direction may also be set to half of the range in which the nozzles N[C], N[M], N[Y], and N[K] in the region A1 on the upstream side of the first region A are distributed in the X direction.

According to the configuration in FIG. 8, not only is it possible to select either of the first region nozzles N[A] and the second region nozzles N[B] for the pre-treatment liquid nozzle rows LP, but it is also possible to select the nozzles of the region A1 and the nozzles of the region A2 for the ink nozzle rows LI1 to LI4.

Third Modification Example of First Embodiment

Figure 9:
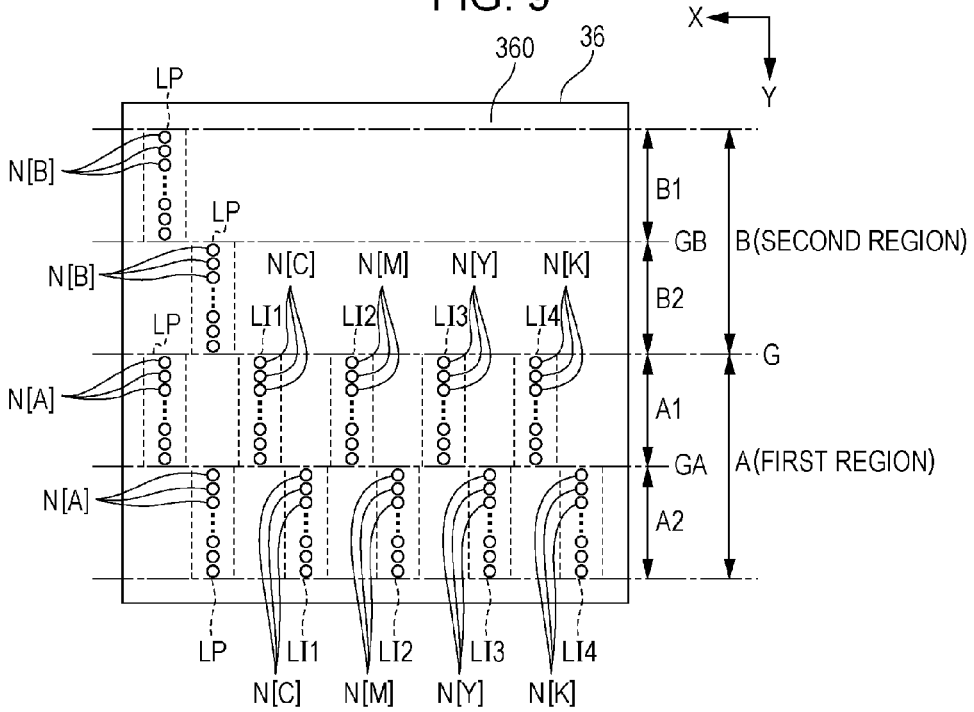
FIG. 9 is a plan view of the ejection surface of the liquid ejecting head according to a third modification example of the first embodiment.

Description will be given of the liquid ejecting head 36 according to a third modification example of the first embodiment. FIG. 9 is a plan view of the ejection surface 360 of the liquid ejecting head 36 according to the third modification example of the first embodiment. The liquid ejecting head 36 in FIG. 9 is different to that in FIG. 7 in that, in addition to the first region A of the liquid ejecting head 36, the second region B is also further divided into a region B1 on the upstream side and a region B2 on the downstream side in the Y direction (the transport direction of the medium 22). For example, assuming a straight line GB parallel to the X direction in the first region B of the ejection surface 360, the upstream side of the straight line GB in the Y direction is the region B1 and the downstream side of the straight line GB in the Y direction is the region B2. In the liquid ejecting head 36 in FIG. 9, the first region nozzles N[A] are arranged in each of the region A1 on the upstream side and the region A2 on the downstream side of the first region A, and the second region nozzles N[B] are arranged in each of the region B1 on the upstream side and the region B2 on the downstream side of the second region B.

According to the configuration in FIG. 9, for the pre-treatment liquid nozzle rows LP, it is also possible to eject the pre-treatment liquid 40 by selecting the nozzles corresponding to any one of nozzles of the region A1 on the upstream side and the nozzles of the region A2 on the downstream side of the first region A or the nozzles corresponding to any one of nozzles of the region B1 on the upstream side and the nozzles of the region B2 on the downstream side of the second region B with the first region nozzles N[A] and the second region nozzles N[B]. For the ink nozzle rows LI1 to LI4, it is also possible to select the nozzles of the region A1 and the nozzles of the region A2. Accordingly, since the selection combinations of the nozzles of the pre-treatment liquid 40 and the ink 41 are further increased compared to the liquid ejecting head 36 shown in FIG. 7, the possible selection options for the landing time difference between the pre-treatment liquid 40 and the ink 41 are also increased, making it possible to more finely adjust the landing time difference.

In addition, according to the configuration in FIG. 9, in the case of the medium 22*a* with high absorbency, the pre-treatment liquid 40 is ejected from the nozzles of both of the region A1 and the region A2 for the first region nozzles N[A], and in the case of the medium 22*b* with low absorbency, the pre-treatment liquid 40 is ejected from the nozzles of both of the region B1 and the region B2 for the second region nozzles N[B]. In addition, for the nozzles N[C], N[M], N[Y], and N[K], it is possible to eject the ink 41 from the nozzles of the region A1 on the upstream side and the nozzles of the region A2 on the downstream side of the first region A. Due to this, it is possible to increase the printing speed since the range of the nozzles which eject the pre-treatment liquid 40 or the ink 41 is increased in the Y direction at once in comparison with a case where the nozzles of either of the region A1 and the region A2 are selected or a case where nozzles of either of the region B1 and the region B2 are selected.

Fourth Modification Example of First Embodiment

Figure 10:
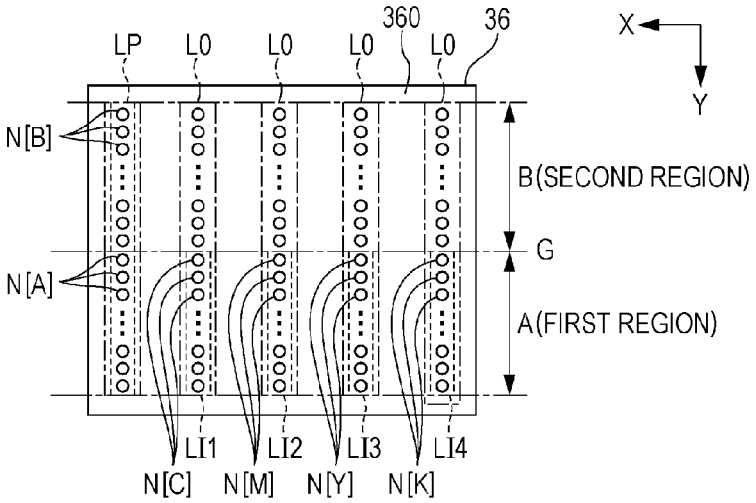
FIG. 10 is a plan view of the ejection surface of the liquid ejecting head according to a fourth modification example of the first embodiment.

Description will be given of the liquid ejecting head 36 according to a fourth modification example of the first embodiment. FIG. 10 is a plan view of the ejection surface 360 of the liquid ejecting head 36 according to the fourth modification example of the first embodiment. In the configuration in FIG. 10, a plurality of nozzle rows L0 is formed on the ejection surface 360 of the liquid ejecting head 36. The plurality of nozzle rows L0 is a set of a plurality of nozzles N arrayed in the Y direction from the first region A to the second region B. The range in which the plurality of nozzles N is distributed in the Y direction is common across the plurality of nozzle rows L0. One arbitrary nozzle row L0 is used as the pre-treatment liquid nozzle row LP and the other four nozzle rows L0 are used as ink nozzle rows LI1 to LI4.

In the nozzle row L0 which is used as the pre-treatment liquid nozzle row LP, predetermined number of nozzles N positioned in the first region A are used as the first region nozzles N[A] and predetermined nozzles N positioned in the second region B are used as the second region nozzles N[B]. From among the four nozzle rows L0 used as the ink nozzle rows LI1 to LI4, predetermined number of nozzles N positioned in the first region A are used as the nozzles N[C], N[M], N[Y], and N[K]. That is, the positional relationship between each of the nozzles is the same as in FIG. 2. It should be noted that, among the plurality of nozzle rows L0, for example, for each of the nozzles N which are not used, the flow path up to the nozzle N is blocked and the non-ejection state (a state where it is not possible to eject the liquid) is maintained. Since the positional relationship of each of the nozzles used in FIG. 10 is the same as that in FIG. 2, it is possible to exhibit the same effects as the liquid ejecting head 36 in FIG. 2. It should be noted that the positional relationship of each of the nozzle used in FIG. 10 is exemplified with the same case as in FIG. 2 as an example; however, without being limited thereto, it is also possible to have the same nozzle arrangement as in FIG. 7 to FIG. 9 by adjusting the number of the plurality of nozzle rows L0 or the intervals in the X direction and appropriately selecting the nozzles to be used. In this manner, according to the configuration in FIG. 10, since the nozzles of a portion of the plurality of nozzle rows arrayed in the X direction spaced at intervals from each other in the liquid ejecting head 36 are used as the nozzles of the pre-treatment liquid 40 and the ink 41, it is possible to change the arrangement of the pre-treatment liquid 40 and the ink 41 according to the position of the nozzle to be used.

Second Embodiment

Description will be given of the second embodiment of the invention. In the first embodiment, description was given of a case where one type of the pre-treatment liquid 40 is used and the landing time difference between the pre-treatment liquid 40 and the ink 41 is changed according to the type of the medium 22; however, in the second embodiment, description will be given of a case where a plurality of pre-treatment liquids 40 are used and the type of the pre-treatment liquid 40 is changed according to the type of the medium 22 in addition to the landing time difference between the pre-treatment liquid 40 and the ink 41 being changed according to the type of the medium 22. It should be noted that, in each of the aspects exemplified below, for elements where the effects and function are the same as the first embodiment, the reference numerals used in the description of the first embodiment are re-used and description of the various details thereof will be omitted as appropriate.

In the first embodiment, description was given of a point where, as the landing time difference between the pre-treatment liquid 40 and the ink 41 is larger, the permeation of the pre-treatment liquid 40 up to immediately before the landing of the ink 41 is more excessive such that the reaction component amount of the pre-treatment liquid 40 remaining on the surface of the medium 22 is changed and the reactivity between the pre-treatment liquid 40 and the ink 41 may be decreased. This phenomenon may be more remarkably apparent depending on the combination of the type of the medium and the pre-treatment liquids 40 with different permeability in addition to the landing time difference of the pre-treatment liquid 40 and the ink 41. For example, since a pre-treatment liquid 40*b*' with high permeability permeates the medium 22 more easily than a pre-treatment liquid 40*a*' with low permeability, even if the landing time difference between the pre-treatment liquids 40 and the ink 41 is the same, with the pre-treatment liquid 40*b*' with high permeability, the pre-treatment liquid 40 permeates excessively and the reaction component amount of the pre-treatment liquid 40 remaining on the surface of the medium 22 is reduced.

(Relationship Between Type of Medium and Permeability of Pre-Treatment Liquid)

Figure 11:
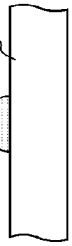
FIG. 11 is a diagram for illustrating a state of the pre-treatment liquid in a case of landing pre-treatment liquids which have different permeability on different types of media.
Figure 11:
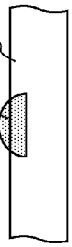
Figure 11:
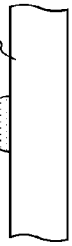
Figure 11:
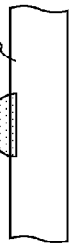
Figure 11:
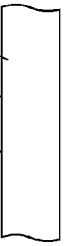
Figure 11:
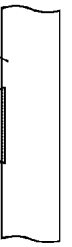
Figure 11:
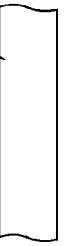
Figure 11:
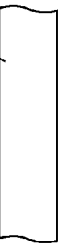

More detailed description will be given below of the relationship between the type of medium and the permeability of the pre-treatment liquid 40. FIG. 11 is a diagram for illustrating the state of the pre-treatment liquid 40 in four cases 5 to 8 where the pre-treatment liquids 40 with different permeability are landed on different types of media.

Here, one type of the pre-treatment liquids 40 with different permeability is either of the pre-treatment liquid 40*a*' with low permeability and the pre-treatment liquid 40*b*' with high permeability. Using a slow permeation pre-treatment liquid as the pre-treatment liquid (first pre-treatment liquid) 40*a*' with low permeability and using a fast permeation pre-treatment liquid as the pre-treatment liquid (second pre-treatment liquid) 40*b*' with high permeability, the landing time difference between the pre-treatment liquid 40*a*' or 40*b*' and the ink 41 is set to be the same. In addition, the different types of the media 22 are either the medium 22*a* with high liquid absorbency (for example, coated paper having an ink absorbing layer) or the medium 22*b* with low liquid absorbency (for example, plastic films such as vinyl chloride).

In FIG. 11, case 5 is a case where the pre-treatment liquid 40*b*' with high permeability is landed on the medium 22*a* with high absorbency, and case 6 is a case where the pre-treatment liquid 40*a*' with low permeability is landed on the medium 22*a* with high absorbency. Case 7 is a case where the pre-treatment liquid 40*b*' with high permeability is landed on the medium 22*b* with low absorbency, and case 8 is a case where the pre-treatment liquid 40*a*' with low permeability is landed on the medium 22*b* with low absorbency.

In the same manner as FIG. 4, the surface residual amount in FIG. 11 is the surface residual amount of the pre-treatment liquid 40*a*' or 40*b*' remaining on the surface of the medium 22*a* or 22*b* immediately before the ink landing. The coating area in FIG. 11 is the area of the medium 22*a* or 22*b* coated by the pre-treatment liquid 40*a*' or 40*b*' remaining on the surface of the medium 22*a* or 22*b* immediately before the ink landing in the same manner as FIG. 4.

In addition, with a super slow permeation liquid as the pre-treatment liquid 40*b*' with high permeability, the penetration into the interior of the medium 22*a* or 22*b* is fast and the wet-spreading on the surface of the medium 22*a* or 22*b* is easy. On the other hand, with a slow permeation liquid as the pre-treatment liquid 40*a*' with low permeability, the permeation into the interior of the medium 22*a* or 22*b* is slow and the wet-spreading on the surface of the medium 22*a* or 22*b* is difficult in comparison with the super slow permeation liquid which is the pre-treatment liquid 40*b*' with high permeability. For this reason, the surface residual amounts and coating areas of the pre-treatment liquid 40*a*' or 40*b*' are different according to the combination of the pre-treatment liquid 40*a*' or 40*b*' and the medium 22*a* or the 22*b* as in cases 1 to 4 in FIG. 4. Detailed description will be given below of each of cases 5 to 8.

First, description will be given of the medium 22*a* with high absorbency in case 5 and case 6 in FIG. 11. As shown in case 5 in FIG. 11, in a case where the pre-treatment liquid 40*b*' with high permeability is landed on the medium 22*a* with high absorbency, the surface residual amount of the pre-treatment liquid 40*b*' is "small" and the coating area is also "small". That is, in such a case, since the absorbency of the medium 22*a* is high, in the pre-treatment liquid 40*b*' with high permeability, the pre-treatment liquid 40*b*' permeates excessively from immediately after the pre-treatment liquid 40*b*' lands until immediately before the ink 41 lands, thus the surface residual amount of the pre-treatment liquid 40*b*' which remains on the surface of the medium 22*a* immediately before the ink landing is excessively reduced and the coating area is also reduced. In addition, since the wet-spreading is easier with the pre-treatment liquid 40*b*' with high permeability, the wet-spreading property is increased. In such a case, when the ink 41 lands in the same manner as the case of case 1 in FIG. 5, since the surface residual amount of the pre-treatment liquid 40*b*' is excessively reduced and the coating area is also small, the reactivity between the pre-treatment liquid 40*b*' and the ink 41 is lowered. For this reason, since the dots landed on the surface of the medium 22*a* tend to spread and aggregate, there is a concern that the printing quality will decrease.

On the other hand, as shown in case 6 in FIG. 11, in a case where the pre-treatment liquid 40*a*' with low permeability is landed on the medium 22*a* with high absorbency, the surface residual amount of the pre-treatment liquid 40*a*' and the coating area are both "medium". In such a case, even with the medium 22*a* with high absorbency, since the permeability of the pre-treatment liquid 40*a*' is low, the pre-treatment liquid 40*a*' does not permeate excessively from immediately after the landing of the pre-treatment liquid 40*a*' on the medium 22*a* until immediately before the landing of the ink 41. For this reason, since the surface residual amount of the pre-treatment liquid 40*a*' is not excessively reduced immediately before the ink landing and the coating area is also moderate, the dots landed on the surface of the medium 22*a* do not tend to aggregate. In a case where the medium 22*a* has high absorbency, if the landing time difference between the pre-treatment liquid 40*a* and the ink 41 great, the pre-treatment liquid 40*a* excessively permeate the medium 22*a* immediately before the ink 41 land on the medium 22*a*; therefore, the surface residual amount is reduced, and dots of the ink 41 landed on the surface of the medium 22*a* spread and easily aggregate to overlap each other and there is a concern that the printing quality will decrease, even though the pre-treatment liquid 40*a* with low permeability has the slow permeation and the weak wet-spreading.

In this manner, although the state of the pre-treatment liquid 40*a*' in case 6 in FIG. 11 is not bad, since the state of the pre-treatment liquid 40*a*' is easily changed and varied according to the time difference from the landing of the pre-treatment liquid 40*a*' until the landing of the ink 41, it is not always possible to provide an environment in which the state of the pre-treatment liquid 40*a*' is stable and favorable for the whole of the printing region of the medium 22*a*.

Next, description will be given of the medium 22*b* with low absorbency in case 7 and case 8 in FIG. 11. As shown in case 7 in FIG. 11, in a case where the pre-treatment liquid 40*b*' with high permeability is landed on the medium 22*b* with low absorbency, the surface residual amount of the pre-treatment liquid 40*b*' is "medium" and the coating area is "large". That is, in such a case, since the absorbency of the medium 22*b* is low, with the pre-treatment liquid 40*b*' with high permeability, the pre-treatment liquid 40*b*' does not permeate excessively from immediately after the landing of the pre-treatment liquid 40*b*' until immediately before the ink 41 lands and the fixation is good, which is favorable. For this reason, the surface residual amount of the pre-treatment liquid 40*b*' is not excessively reduced, the dots of the ink 41 landing on the surface of the medium 22*b* do not easily aggregate, and the color reproduction of the ink 41 is also favorable. However, in a case where the medium 22*b* has low absorbency even with the pre-treatment liquid 40*b*' with high permeability, if the landing time difference between the pre-treatment liquid 40*b*' and the ink 41 small, the drying of the pre-treatment liquid 40*b*' is not completed in time, the surface residual amount of the pre-treatment liquid 40*b*' is excessively large up to immediately before the landing of ink 41, and the drying time for solution components such as water and solvents is insufficient. In such a case, the reactivity between the pre-treatment liquid 40*b*' and the ink 41 decreases, and there is a concern that the printing quality will decrease.

In this manner, although the state of the pre-treatment liquid 40*b*' in case 7 in FIG. 11 is not bad, since the state of the pre-treatment liquid 40*b*' is easily changed and varied according to the time difference from the landing of the pre-treatment liquid 40*b*' until the landing of the ink 41, it is not always possible to provide an environment in which the state of the pre-treatment liquid 40*b*' is stable and favorable for the whole of the printing region of the medium 22*b*.

On the other hand, as shown in case 8 in FIG. 11, in a case where the pre-treatment liquid 40*a*' with low permeability is landed on the medium 22*b* with low absorbency, the surface residual amount of the pre-treatment liquid 40*a*' is "large" and the coating area is "medium". That is, in such a case, since the absorbency of the medium 22*b* is low, with the pre-treatment liquid 40*a* with low permeability, the surface residual amount of the pre-treatment liquid 40*a*' is not excessively reduced from immediately after the landing of the pre-treatment liquid 40*a*' until immediately before the ink 41 lands. In such a case, when the ink 41 lands as shown in case 4 in FIG. 5, the dots landed on the surface of the medium 22*b* are not easily aggregated. However, on the other hand, since the pre-treatment liquid 40*a*' permeates less easily and the fixation is also poor, the color reproduction of the ink 41 is decreased. Moreover, since the permeability of the pre-treatment liquid 40*a*' is low, the wet-spreading is not easy, the contact area between the pre-treatment liquid 40*a*' and the ink 41 is also reduced and the reactivity is also decreased.

According to the above, to improve the print image quality, from the point of view of the surface residual amount (the permeability) of the pre-treatment liquid, it is understood that the pre-treatment liquid 40*a*' with low permeability is more favorable for the medium 22*a* with high absorbency such as in case 6 in FIG. 11 than the pre-treatment liquid 40*b*' with high permeability, and that the pre-treatment liquid 40*b*' with high permeability is more favorable for the medium 22*b* with low absorbency such as in case 7 in FIG. 11 than the pre-treatment liquid 40*a*' with low permeability. There is a lot of room for improvement even as for the combination in the case 6 and the case 7, in order for the state of the surface residual amount of the pre-treatment liquid 40 until immediately before the landing of the ink 41 to be more suitable.

In the second embodiment, the pre-treatment liquid 40*a*' with low permeability is used on the medium 22*a* with high absorbency and the pre-treatment liquid 40*b*' with high permeability is used on the medium 22*b* with low absorbency. Due to this, regardless of the type of the medium 22, it is possible to increase the reactivity between the pre-treatment liquid 40 and the ink 41. Furthermore, since it is possible to adjust the permeability and the drying property by changing the landing time difference between each of the pre-treatment liquids 40 and the ink 41 as in the first embodiment, it is also possible to adjust the wet-spreading of the pre-treatment liquid 40.

(Liquid Ejecting Head of Second Embodiment)

Figure 12:
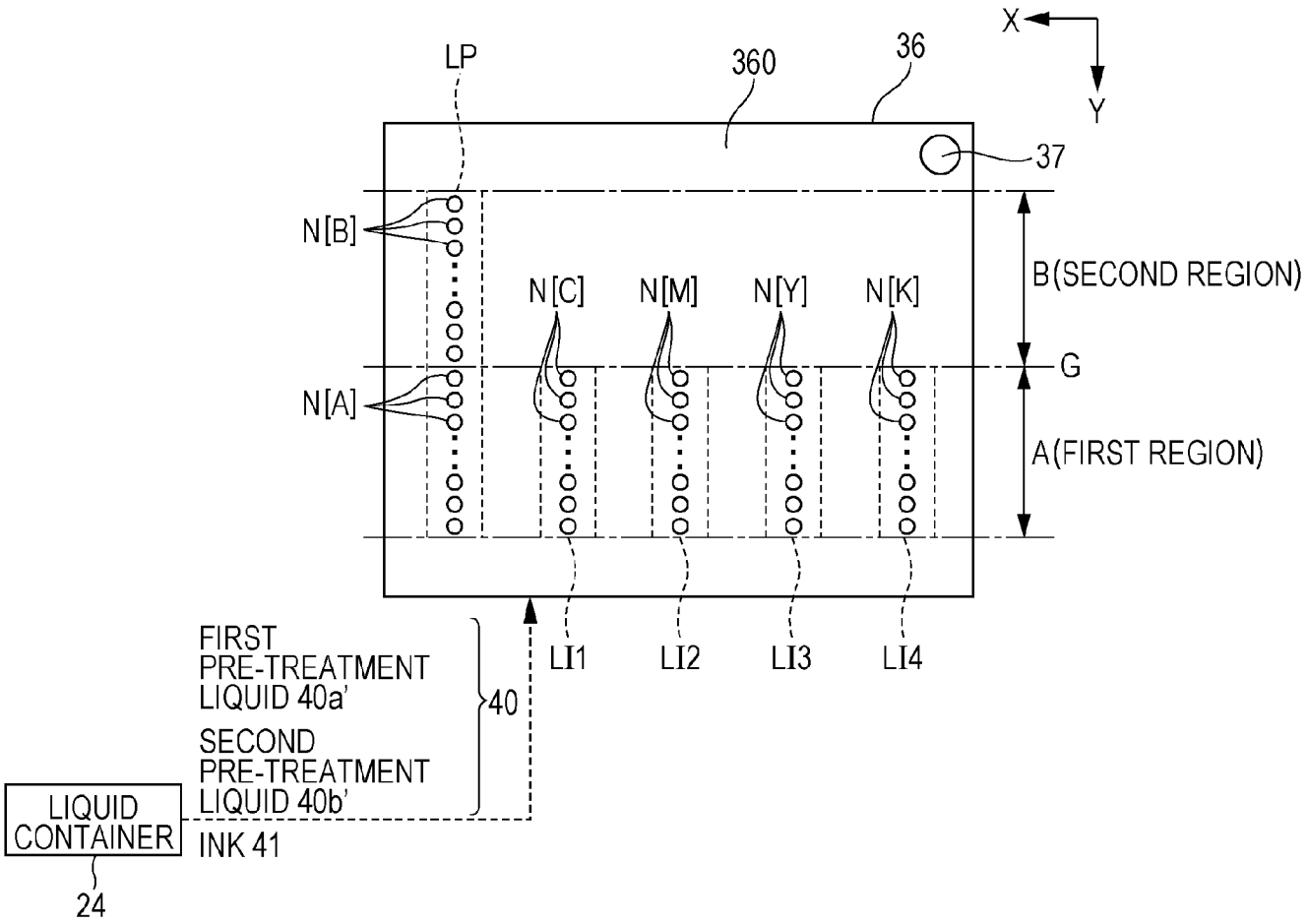
FIG. 12 is a plan view of the ejection surface of the liquid ejecting head according to a second embodiment.

Next, description will be given of a configuration example of the liquid ejecting head 36 of the second embodiment in which it is possible to change the landing time difference between the pre-treatment liquid 40 and the ink 41 according to the medium 22 and to change the type of the pre-treatment liquid 40. FIG. 12 is a plan view of the ejection surface of the liquid ejecting head according to a second embodiment. Examples of the pre-treatment liquid 40 of the liquid ejecting head 36 in FIG. 12 include a case of using two types of the pre-treatment liquid 40 of the first pre-treatment liquid 40*a*' with low permeability with respect to the medium 22 and the second pre-treatment liquid 40*b*' with higher permeability than the first pre-treatment liquid 40*a*'.

The first pre-treatment liquid 40*a*' and the second pre-treatment liquid 40*b*' are reactive components in the same manner as the pre-treatment liquid 40 of the first embodiment and differ in the permeability with respect to the medium 22. Specific examples of the first pre-treatment liquid 40*a*' include a slow permeation pre-treatment liquid with low permeability which permeates the medium 22 slowly. Specific examples of the second pre-treatment liquid 40*b*' include a fast permeation pre-treatment liquid with high permeability which permeates the medium 22 more quickly than the slow permeation pre-treatment liquid. The terms "fast permeation" and "slow permeation" have the meaning of relative characteristics.

In FIG. 12, two types of the pre-treatment liquid 40 of the first pre-treatment liquid 40*a*' and the second pre-treatment liquid 40*b*' are supplied to the liquid ejecting head 36 with the same configuration as in FIG. 2. The first pre-treatment liquid 40*a*' and the second pre-treatment liquid 40*b*' are individually stored in the liquid container 24 shown in FIG. 12. It should be noted that, in FIG. 12, the liquid container 24 is illustrated as one element for convenience; however, it is also possible to adopt a configuration in which a plurality of pre-treatment liquids 40 and a plurality of types of the ink 41 are stored in separate liquid containers 24, or a configuration in which each of a plurality of types of the ink 41 are stored in separate liquid containers 24.

According to the liquid ejecting head 36 in FIG. 12, by adopting a configuration in which the plurality of first region nozzles N[A] eject the first pre-treatment liquid 40*a*' and the plurality of second region nozzles N[B] eject the second pre-treatment liquid 40*b*', it is possible to change the landing time difference between each of the pre-treatment liquids 40*a*' and 40*b*' and the ink 41 according to the type of the medium 22 and it is also possible to change the type of the pre-treatment liquid to either of the first pre-treatment liquid 40*a*' and the second pre-treatment liquid 40*b*'.

(Liquid Ejecting Method of Second Embodiment)

Figure 13:
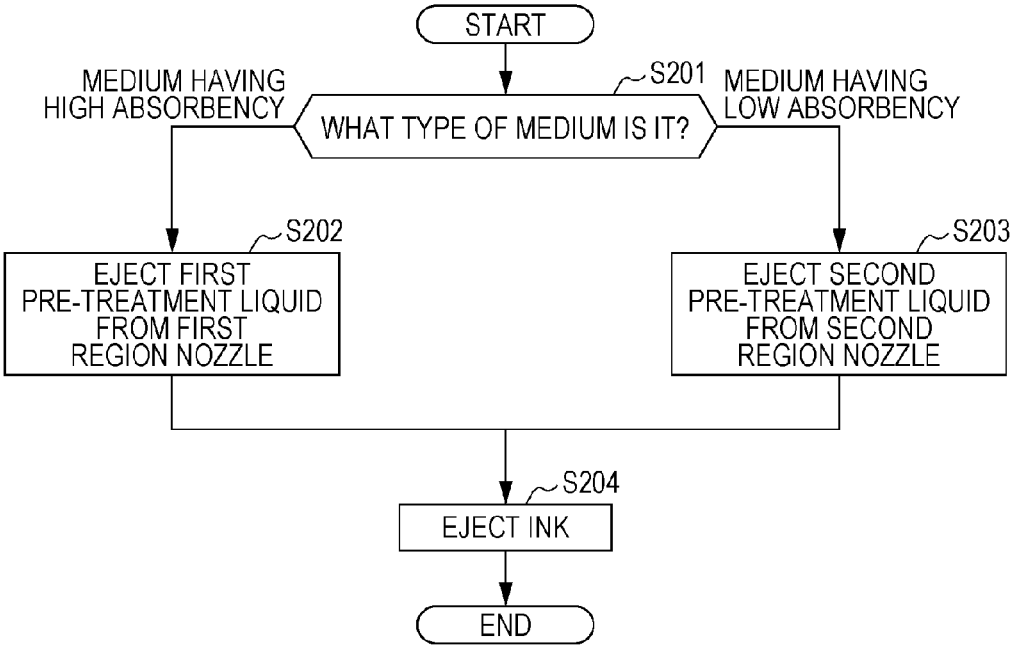
FIG. 13 is a flowchart which shows control of the liquid ejecting head according to the second embodiment.

Based on the above, description will be given of the liquid ejecting method of the second embodiment with control of the liquid ejecting head 36 in FIG. 12 as an example. FIG. 13 is a flowchart which shows control of the liquid ejecting head 36 during printing control. The control unit 30 reads a predetermined program from the ROM 301 according to an instruction from the management apparatus and carries out the printing control on the medium 22. In the printing control, the control unit 30 controls the liquid ejecting head 36 shown in FIG. 13 while carrying out the transfer control of the medium 22.

First, in step S201, the determination unit 303 determines the type of the medium 22 to be printed. Specifically, the same process as in step S101 in FIG. 6 is performed. In step S201, in a case where the determination unit 303 determines that the medium is the medium 22*a* with high absorbency, in step S202, the control unit 30 ejects the first pre-treatment liquid 40*a*' with low permeability by selecting the first region nozzles N[A] of the pre-treatment liquid nozzle row LP while moving the carriage 342 moving. In step S204, the control unit 30 ejects the ink 41 of the required color from the nozzles N[C], N[M], N[Y], and N[K] of the ink nozzle rows LI1 to LI4 to land on the medium 22*a* on the portion where the first pre-treatment liquid 40*a*' is landed while moving the carriage 342 backward without transporting the medium 22*a* in the Y direction.

In contrast, in a case where the determination unit 303 determines that the medium is the medium 22*b* with low absorbency in step S201, in step S203, the control unit 30 ejects the second pre-treatment liquid 40*b*' with high permeability by selecting the second region nozzles N[B] of the pre-treatment liquid nozzle rows LP while moving the carriage 342 forward. In step S204, the control unit 30 ejects the ink 41 of the required colors from the nozzles N[C], N[M], N[Y], and N[K] in the ink nozzle rows LI1 to LI4 on the portion where the second pre-treatment liquid 40*b*' landed after transporting the medium 22*b* in the Y direction and lands the ink 41 on the medium 22*b*.

According to the printing control of the second embodiment, with respect to the medium 22*a* with high absorbency, it is possible to eject the first pre-treatment liquid 40*a*' with low permeability as in case 6 in FIG. 11 by selecting the first region nozzles N[A] and it is possible to further reduce the landing time difference between the first pre-treatment liquid 40*a*' and the ink 41, thus it is possible to increase the effect of suppressing the permeation into the medium 22*a*. On the other hand, with respect to the medium 22*b* with low absorbency, it is possible to eject the second pre-treatment liquid 40*b*' with high permeability as in case 7 in FIG. 11 by selecting the second region nozzles N[B] and it is possible to further increase the landing time difference between the second pre-treatment liquid 40*b*' and the ink 41, thus it is possible to improve the wet-spreading on the medium 22*b* and the drying property. Accordingly, in comparison with a case of changing only the landing time difference of the pre-treatment liquid and the ink, regardless of the type of the medium 22, it is possible to further increase the effect of improving the reactivity with the ink 41 and it is possible to further improve the printing quality.

In the control shown in FIG. 13, description was given of ejecting the first pre-treatment liquid 40*a*' from the first region nozzles N[A] when moving the carriage 342 forward in a case of the medium 22*a* with high absorbency (step S202), and a case of ejecting the ink 41 from the ink nozzle rows LI1 to LI4 when moving the carriage 342 backward (step S204); however, the invention is not limited thereto. That is, since the liquid ejecting head 36 in FIG. 12 has the same configuration as in FIG. 2, the first region nozzles N[A] are arranged in the same first region A so as to overlap in plan view with the ink nozzle rows LI1 to LI4 in the X direction, thus it is possible to eject both of the first pre-treatment liquid 40*a*' and the ink 41 when moving the carriage 342 forward. Due to this, it is also possible to land the first pre-treatment liquid 40*a*' and the ink 41 almost simultaneously on the medium 22*a* with little time difference.

Third Embodiment

Description will be given of a third embodiment of the invention. In the second embodiment, description was given of the liquid ejecting head 36 which is able to land any one of two types of the pre-treatment liquids 40 with different permeability according to the type of the medium 22 using two types of the pre-treatment liquids 40 with a different permeability; however, in the third embodiment, description will be given of the liquid ejecting head 36 which is able to change the overlapping order of the plurality of the pre-treatment liquids 40 according to the type of the medium 22 using the plurality of pre-treatment liquids 40 with different permeability. Due to this, in comparison with a case of using one type of the pre-treatment liquid 40, it is possible to further improve the permeability and the wet-spreading.

(Medium Type and Plurality of Pre-Treatment Liquids)

Figure 14:
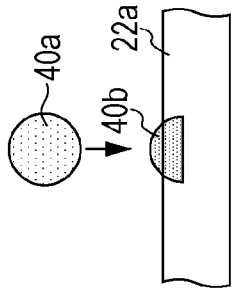
FIG. 14 is a diagram for illustrating a state of the pre-treatment liquid in a case of changing an overlapping order of the pre-treatment liquid according to the type of medium.
Figure 14:
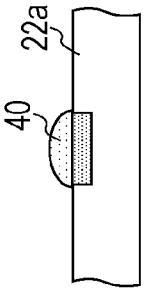
Figure 14:
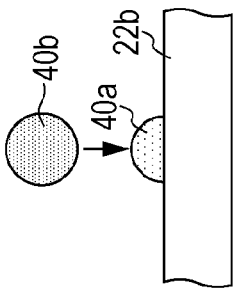
Figure 14:
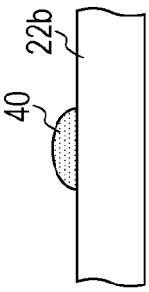

Here, description will be given of the state of the pre-treatment liquid 40 and the state of the ink 41 in a case where a plurality of the pre-treatment liquids 40 with different permeability are overlapped. FIG. 14 is a diagram for illustrating a state of the pre-treatment liquid 40 in two of case 9 and case 10 where the overlapping order of the pre-treatment liquids 40 is changed according to the type of medium. In FIG. 14, two types of the first pre-treatment liquid 40*a* with low permeability and the second pre-treatment liquid 40*b* with high permeability are used as the plurality of pre-treatment liquids 40 with different permeability. Using a slow permeation pre-treatment liquid as the first pre-treatment liquid 40*a* with low permeability and using a fast permeation pre-treatment liquid as the second pre-treatment liquid 40*b* with high permeability, the landing time difference between the pre-treatment liquid 40 and the ink 41 is the same. In addition, the different types of the media 22 are either the medium 22*a* with high liquid absorbency (for example, coated paper having an ink absorbing layer) or the medium 22*b* with low liquid absorbency (for example, plastic films such as vinyl chloride).

Figure 15:
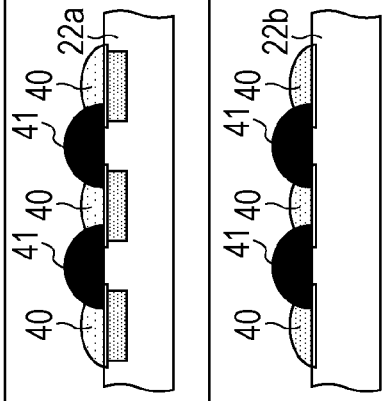
FIG. 15 is a diagram for illustrating a state of the ink immediately after ink landing and after a predetermined time elapsed in FIG. 14.
Figure 15:
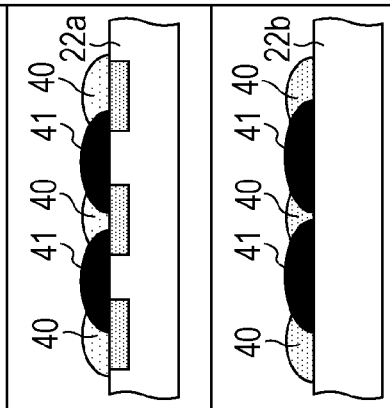

Case 9 in FIG. 14 is a case where the first pre-treatment liquid 40*a* with low permeability is landed and overlapped after landing the second pre-treatment liquid 40*b* with high permeability on the medium 22*a* with high absorbency. Case 10 in FIG. 14 is a case where the second pre-treatment liquid 40*b* with high permeability is landed and overlapped after landing the first pre-treatment liquid 40*a* with low permeability on the medium 22*b* with low absorbency. FIG. 15 is a diagram for illustrating the state of the ink 41 immediately after the landing of the ink 41 and after a predetermined time elapses in each of case 9 and 10 in FIG. 14. The pre-treatment liquid 40 in FIG. 14 and FIG. 15 are the second pre-treatment liquid 40*b* and the first pre-treatment liquid 40*a* after being overlapped.

As shown in case 9 in FIG. 14, the first pre-treatment liquid 40*a* with low permeability is landed and overlapped after landing the second pre-treatment liquid 40*b* with high permeability on the medium 22*a* with high absorbency. In case 9, the surface residual amount of the pre-treatment liquid 40 is "medium" and the coating area is also "medium". According to case 9, first landing the second pre-treatment liquid 40*b* with high permeability makes it possible to suppress permeation of the first pre-treatment liquid 40*a* with low permeability to be landed subsequently. Accordingly, the wet-spreading is easier as a whole, it is possible to increase the surface residual amount of the pre-treatment liquid 40 remaining on the surface of the medium 22, and it is possible to increase the coating area, thus as shown in case 9 in FIG. 15, not only does aggregation of the landed ink 41 hardly occur, but it is also possible to increase the wet-spreading while increasing the reactivity with the ink 41. Moreover, it is also possible to improve the color reproduction of the ink 41 since the first pre-treatment liquid 40*a* land on the spot where the second pre-treatment liquid 40*b* wet-spread and permeate, and the second pre-treatment liquid 40*b* with high permeability is a sealant of the subsequent first pre-treatment liquid 40*a* with low permeability and it is possible to increase the fixing property of the pre-treatment liquid 40. Due to this, it is possible to further improve the printing quality in comparison with a case of only using the first pre-treatment liquid 40*a* with low permeability on the medium 22*a* with high liquid absorbency.

On the other hand, as shown in case 10 in FIG. 14, the second pre-treatment liquid 40*b* with high permeability is landed and overlapped after landing the first pre-treatment liquid 40*a* with low permeability on the medium 22*b* with low absorbency. Even in case 10 in FIG. 14, the surface residual amount of the pre-treatment liquid 40 is "medium" and the coating area is also "medium". According to case 10, first landing the first pre-treatment liquid 40*a* with low permeability makes it possible to increase the reactivity with the ink 41 while suppressing the wet-spreading to the second pre-treatment liquid 40*b* with high permeability to be landed subsequently. Here in a case where the absorbency of the medium 22*b* is extremely low, since permeation is difficult and drying property is poor even for the second pre-treatment liquid 40*b*, it is possible to improve the drying property by reducing the dots by reducing the amount of droplets of the first pre-treatment liquid 40*a* and the second pre-treatment liquid 40*b*. Moreover, even when the amount of droplets of the second pre-treatment liquid 40*b* is reduced, since it is possible to compensate for the reaction component using the first pre-treatment liquid 40*a* with low permeability to be landed which is remained on the medium 22*b*, it is possible to improve the reactivity with the ink 41. Accordingly, since it is also possible to more properly adjust the amount of the surface residual amount of the pre-treatment liquid 40 while controlling the wet-spreading and the drying property as a whole, it is possible to improve the wet-spreading and the drying property while increase the reactivity with the landed ink 41 as shown in case 10 of FIG. 15. Due to this, it is possible to improve the printing quality in comparison with a case of using only the second pre-treatment liquid 40*b* with high permeability on the medium 22*b* with low absorbency.

Furthermore, in the third embodiment, it is possible to provide a higher printing quality by not only changing the overlapping order of the two types of the pre-treatment liquid 40 according to the medium 22, but also the landing time difference between the pre-treatment liquid 40*a* or 40*b* and the ink 41.

(Liquid Ejecting Head of Third Embodiment)

Figure 16:
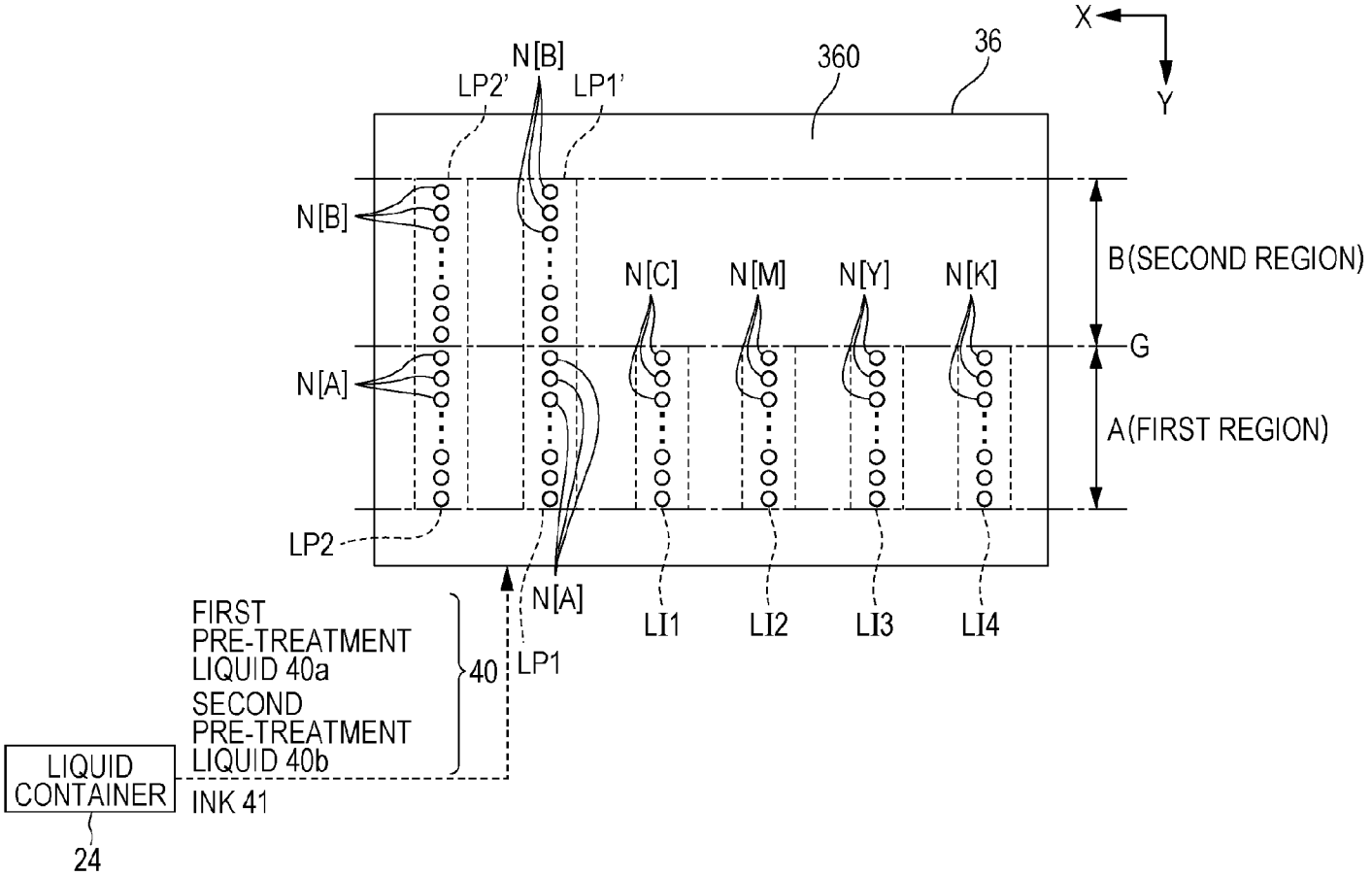
FIG. 16 is a plan view of the ejection surface of the liquid ejecting head according to a third embodiment.

Next, description will be given of a configuration example of the liquid ejecting head 36 of the third embodiment in which it is possible to change not only the landing time difference between the pre-treatment liquid 40 and the ink 41 according to the medium 22, but also the overlapping order of the two types of the pre-treatment liquid 40. FIG. 16 is a plan view of the ejection surface of the liquid ejecting head according to the third embodiment. The liquid ejecting head 36 in FIG. 16 is different to that in FIG. 12 in that, two pre-treatment liquid nozzle rows LP1 and LP2 are arrayed in the X direction to be spaced at intervals in the first region A and two pre-treatment liquid nozzle rows LP1' and LP2' are arrayed in the X direction to be spaced at intervals in the first region B. The configuration of the ink nozzle rows LI1 to LI4 is the same as that in FIG. 2.

The pre-treatment liquid nozzle rows LP1 and LP2 are both a set of the plurality of first region nozzles N[A] arrayed in a linear form in the Y direction and the pre-treatment liquid nozzle rows LP1' and LP2' are both a set of the plurality of second region nozzles N[B] arrayed in a linear form in the Y direction. In the configuration shown in FIG. 16, the pre-treatment liquid nozzle rows LP1 and LP2 are arranged in order of the pre-treatment liquid nozzle row LP2 and the pre-treatment liquid nozzle rows LP1 in the movement direction (to the positive side in the X direction) of the carriage 342 and the pre-treatment liquid nozzle rows LP1' and LP2' are arranged in order of the pre-treatment liquid nozzle row LP2' and the pre-treatment liquid nozzle rows LP1' in the movement direction (to the positive side in the X direction) of the carriage 342. In addition, the first region nozzles N[A] of the pre-treatment liquid nozzle rows LP1 and LP2 are overlapped in plan view in the X direction and the second region nozzles N[B] of the pre-treatment liquid nozzle rows LP1' and LP2' are overlapped in plan view in the X direction.

According to this configuration, in the first region nozzles N[A] of each of the pre-treatment liquid nozzle rows LP1 and LP2, it is possible to set one as a nozzle which ejects the first pre-treatment liquid 40*a* and the other as a nozzle which ejects the second pre-treatment liquid 40*b*. In addition, in the second region nozzles N[B] of each of the pre-treatment liquid nozzle rows LP1' and LP2', it is possible to set one as a nozzle which ejects the first pre-treatment liquid 40*a* and the other as a nozzle which ejects the second pre-treatment liquid 40*b*.

Here, the first region nozzles N[A] of the pre-treatment liquid nozzle row LP1 are set as nozzles which eject the first pre-treatment liquid 40*a* and the first region nozzles N[A] of the pre-treatment liquid nozzle row LP2 are set as nozzles which eject the second pre-treatment liquid 40*b*. In addition, the second region nozzles N[B] of the pre-treatment liquid nozzle row LP1' are set as nozzles which eject the second pre-treatment liquid 40*b* and the second region nozzles N[B] of the pre-treatment liquid nozzle row LP2' are set as nozzles which eject the first pre-treatment liquid 40*a*. That is, in the first region A and the first region B, the nozzle row which ejects the first pre-treatment liquid 40*a* and the nozzle row which ejects the second pre-treatment liquid 40*b* are arranged to be lined up in a staggered order to each other as seen from the Y direction.

In the liquid ejecting head 36 in FIG. 16, the first region nozzles N[A] of the pre-treatment liquid nozzle rows LP1 and LP2 are arranged in the first region A so as to overlap in a range in which the plurality of ink nozzles is distributed in the X direction, and the second region nozzles N[B] of the pre-treatment liquid nozzle rows LP1' and LP2' are arranged in the second region so as to not overlap in a range in which the plurality of ink nozzles is distributed in the X direction. Therefore, by selecting the first region nozzles N[A] of the pre-treatment liquid nozzle rows LP1 and LP2 or the second region nozzles N[B] of the pre-treatment liquid nozzle rows LP1' and LP2', it is possible to change the landing time difference with the ink 41 to be landed subsequently.

Furthermore, in a case of selecting the first region nozzles N[A] and a case of selecting the second region nozzles N[B], it is possible to change the order of landing the first pre-treatment liquid 40*a* and the second pre-treatment liquid 40*b*. In such a case, by arranging the nozzle row which ejects the first pre-treatment liquid 40*a* and the nozzle row which ejects the second pre-treatment liquid 40*b* in the first region A and the first region B so as to line up in a staggered order to each other as seen from the Y direction, it is possible to change the landing order of the first pre-treatment liquid 40*a* and the second pre-treatment liquid 40*b* when moving the carriage 342 in the same direction, thus, in comparison with a case where the nozzle row which ejects the first pre-treatment liquid 40*a* and the nozzle row which ejects the second pre-treatment liquid 40*b* are lined up in the same order as seen from the Y direction, when the first pre-treatment liquid 40*a* and the second pre-treatment liquid 40*b* are overlapped, it is possible to change the overlapping order of the first pre-treatment liquid 40*a* and the second pre-treatment liquid 40*b* even when the carriage 342 does not return. Accordingly, even when the overlapping order of the first pre-treatment liquid 40*a* and the second pre-treatment liquid 40*b* is changed, it is possible to avoid generating a landing time difference between the first pre-treatment liquid 40*a* and the second pre-treatment liquid 40*b*. In this manner, according to the configuration in FIG. 16, it is possible to change not only the landing time difference between the pre-treatment liquid 40 and the ink 41 according to the type of the medium 22, but also the overlapping order of the first pre-treatment liquid 40*a* and the second pre-treatment liquid 40*b* according to the type of the medium 22.

(Liquid Ejecting Method of Third Embodiment)

Figure 17:
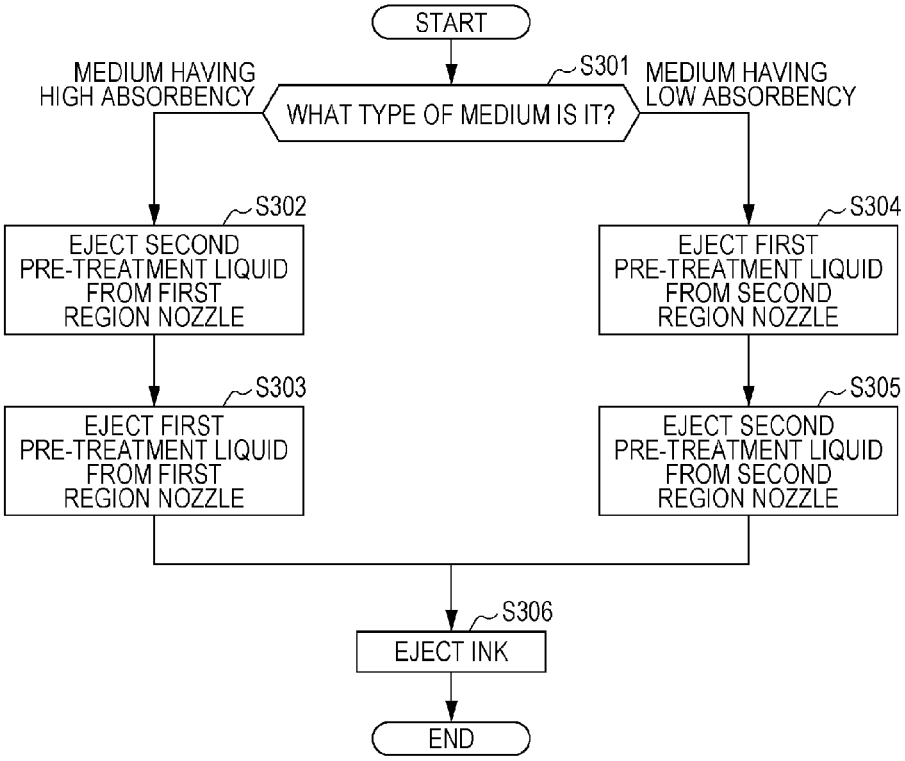
FIG. 17 is a flowchart which shows control of the liquid ejecting head according to the third embodiment.

Based on the above, description will be given of a liquid ejecting method of the third embodiment by using control of the liquid ejecting head 36 in FIG. 16 as an example. FIG. 17 is a flowchart which shows control of the liquid ejecting head 36 in the printing control. The control unit 30 reads a predetermined program from the ROM 301 according to an instruction from the management apparatus and carries out the printing control on the medium 22. In the printing control, the control unit 30 controls the liquid ejecting head 36 shown in FIG. 17 while carrying out the transfer control of the medium 22.

First, in step S301, the determination unit 303 determines the type of the medium 22 to be printed. Specifically, the same process as in step S101 in FIG. 6 is performed. In a case where the determination unit 303 determines that the medium is the medium 22*a* with high absorbency in step S301, in step S302, the control unit 30 ejects the second pre-treatment liquid 40*b* with high permeability by selecting the first region nozzles N[A] of the pre-treatment liquid nozzle row LP2 while moving the carriage 342 forward to land on the medium 22*a*, in step S303, the first pre-treatment liquid 40*a* with low permeability is ejected by selecting the first region nozzles N[A] of the pre-treatment liquid nozzle row LP1 to land on the medium 22*a*, and the first pre-treatment liquid 40*a* is overlapped with the second pre-treatment liquid 40*b*.

In step S306, the control unit 30 ejects the ink 41 of the required color from the nozzles N[C], N[M], N[Y], and N[K] of the ink nozzle rows LI1 to LI4 to land on the medium 22*a* on the portion where the second pre-treatment liquid 40*b* and the first pre-treatment liquid 40*a* are overlapped while moving the carriage 342 backward without transporting the medium 22*a* in the Y direction.

In contrast, in a case where the determination unit 303 determines that the medium is the medium 22*b* with low absorbency in step S301, in step S304, the control unit 30 ejects the first pre-treatment liquid 40*a* with low permeability by selecting the second region nozzles N[B] of the pre-treatment liquid nozzle row LP2' while moving the carriage 342 forward to land on the medium 22*b*, then, in step S305, selects the second region nozzles N[B] of the pre-treatment liquid nozzle row LP1', ejects the second pre-treatment liquid 40*b* with high permeability to land on the medium 22*b*, and overlaps the second pre-treatment liquid 40*b* on the first pre-treatment liquid 40*a*.

In step S306, the control unit 30 ejects the ink 41 of the required color from the nozzles N[C], N[M], N[Y], and N[K] of the ink nozzle rows LI1 to LI4 to land on the medium 22*b* on the portion where the first pre-treatment liquid 40*a* and the second pre-treatment liquid 40*b* are overlapped while moving the carriage 342 backward with transporting the medium 22*b* in the Y direction.

According to the printing control of the third embodiment, when the determination unit 303 determines that the medium is the medium 22*a* with high absorbency, the control unit 30 overlaps and lands the first pre-treatment liquid 40*a* with high permeability on the second pre-treatment liquid 40*b* with low permeability on the medium 22, and then lands the ink 41. In contrast, when the determination unit 303 determines that the medium is the medium 22*b* with low absorbency, the control unit 30 overlaps and lands the second pre-treatment liquid 40*b* with high permeability on the first pre-treatment liquid 40*a* with low permeability on the medium 22, and then lands the ink 41. Due to this, with either of the medium 22*a* with high absorbency or the medium 22*b* with low absorbency, it is possible to increase the wet-spreading while increasing the reactivity with the pre-treatment liquid 40, thus it is possible to improve the printing quality regardless of the type of the medium 22.

Moreover, in the same manner as the first embodiment, since it is also possible to change the landing time difference between the pre-treatment liquid 40 and the ink 41 according to the medium 22, it is possible to further increase the reaction component amount of the pre-treatment liquid 40 remaining on the surface of the medium 22 with the medium 22*a* with high absorbency and it is possible to secure the drying time for the solution component such as water or solvents of each of the pre-treatment liquids 40 with the medium 22*b* with low absorbency.

According to the third embodiment described above, it is possible to provide printing quality with higher image quality regardless of the type of the medium 22, compared to the first embodiment in which changes only the landing time difference between the pre-treatment liquid 40 and the ink 41 according to the type of the medium 22. Also in FIG. 17, in the same manner as in the case in FIG. 6, in a case of the medium 22*a* with high absorbency, when the carriage 342 is moving forward, the ink 41 may also be ejected in addition to each of the pre-treatment liquids 40. That is, in the liquid ejecting head 36 in FIG. 16, since the first region nozzles N[A] in the pre-treatment liquid nozzle rows LP1' and LP2' are arranged in the same first region A so as to overlap the ink nozzle rows LI1 to LI4 in the X direction in plan view, when the carriage 342 is moving forward, it is possible to eject not only each of the pre-treatment liquids 40, but also the ink 41. Due to this, it is also possible to land each of the pre-treatment liquid 40 and the ink 41 almost simultaneously on the medium 22*a* with little time difference.

In addition, the liquid ejecting head according to the third embodiment is not limited to the configuration described above. For example, in the configuration in FIG. 16, both the first region nozzles N[A] and the second region nozzles N[B] in the pre-treatment liquid nozzle row LP1 and LP1' may be set as nozzles which eject the first pre-treatment liquid 40*a*, and both the first region nozzles N[A] and the second region nozzles N[B] in the pre-treatment liquid nozzle row LP2 and LP2' may be set as a nozzle which ejects the second pre-treatment liquid 40*b*.

Fourth Embodiment

Description will be given of a fourth embodiment of the invention. In the first embodiment to the third embodiment, the liquid ejecting apparatus 10 which is provided with a serial head in which the carriage 342 mounted with the liquid ejecting head 36 moves in the X direction was exemplified, in the fourth embodiment, the liquid ejecting apparatus 10 which is provided with the liquid ejecting head 36 formed as a long line head in a direction (here, the X direction) intersecting the transport direction of the medium 22 is exemplified.

Figure 18:
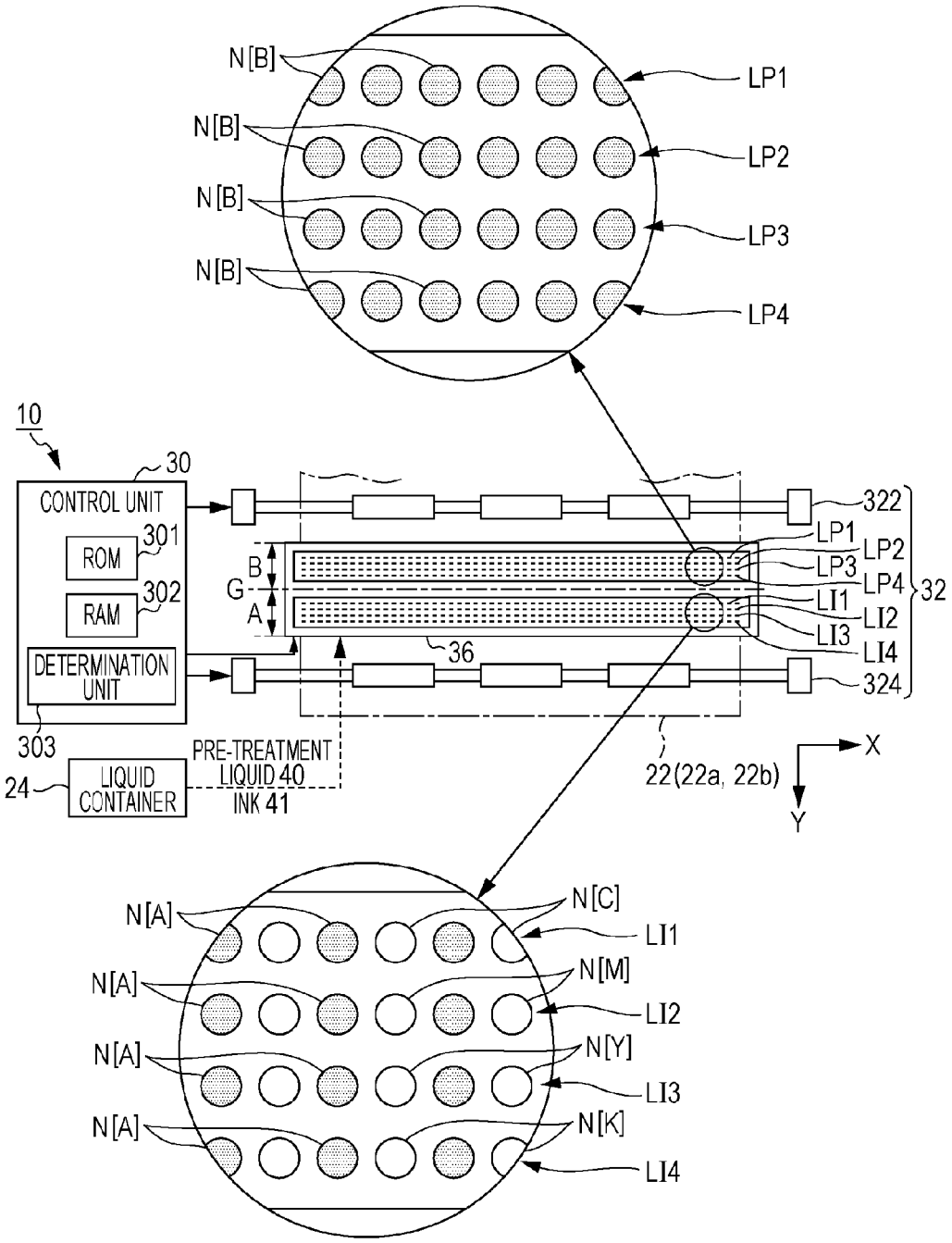
FIG. 18 is a configuration diagram of the liquid ejecting apparatus according to a fourth embodiment.

FIG. 18 is a partial configuration diagram of the liquid ejecting apparatus 10 according to the fourth embodiment of the invention. The liquid ejecting head 36 in the liquid ejecting apparatus 10 shown in FIG. 18 is a line head in which four nozzle rows LP1 to LP4 arranged in the second region B and four nozzle rows LI1 to LI4 arranged in the first region A are arranged in the Y direction at intervals to each other. The nozzle rows LP1 to LP4 in the second region B and the nozzle rows LI1 to LI4 in the first region A are a set of a plurality of nozzles N arrayed in a linear form in the X direction. Here, it is possible to set each of the nozzle rows LP1 to LP4 in the second region B and the nozzle rows LI1 to LI4 in the first region A as a plurality of rows (for example, a zig-zag array or a staggered array).

As shown in the enlarged view of the upper side in FIG. 18, nozzle rows LP1 to LP4 in the second region B are formed of a plurality of nozzles N[B] which eject the pre-treatment liquid 40. On the other hand, as shown in the enlarged view of the lower side in FIG. 18, nozzle rows LI1 to LI4 in the first region A are formed of a plurality of nozzles N[A] which eject the pre-treatment liquid 40 and nozzles N[C], N[M], N[Y], and N[K] which eject the ink 41. Specifically, the nozzles N[A] and nozzles N[C] are arrayed alternately in the X direction in the nozzle row LI1 in the first region A, the nozzles N[A] and nozzles N[M] are arrayed alternately in the X direction in the nozzle row LI2 in the first region A, the nozzles N[A] and nozzles N[Y] are arrayed alternately in the X direction in the nozzle row LI3 in the first region A, and the nozzles N[A] and nozzles N[K] are arrayed alternately in the X direction in the nozzle row LI4 in the first region A.

According to the configuration in FIG. 18, the range in which a plurality of the first region nozzles N[A] is distributed in the X direction overlaps the range in which nozzles N[C], N[M], N[Y], and N[K] of the ink 41 are distributed in the X direction, and the range in which a plurality of the second region nozzles N[B] is distributed in the X direction is on the upstream side which does not overlap the range in which nozzles N[C], N[M], N[Y] and N[K] of the ink 41 are distributed in the X direction.

Accordingly, even when the liquid ejecting head 36 is the line head as shown in FIG. 18, in the same manner as the liquid ejecting head 36 shown in FIG. 2, by ejecting the pre-treatment liquid 40 by selecting either of the first region nozzles N[A] or the second region nozzles N[B], it is possible to change the landing time difference between the pre-treatment liquid 40 and the ink 41 to be landed subsequently on the medium 22 by being ejected from the nozzles N[C], N[M], N[Y], and N[K].

The liquid ejecting head 36 of each embodiment described above functions as a liquid ejecting unit which ejects the ink 41 and also functions as a pre-treatment liquid coating mechanism which coats the pre-treatment liquid 40 on the medium 22. Specifically, in the liquid ejecting head 36, the constituent element which ejects the ink 41 (including the nozzles of the ink nozzle rows LI1 to LI4) functions as a liquid ejecting unit, the constituent element which ejects the pre-treatment liquid 40 arranged in the first region A (including the first region nozzles N[A]) functions as a first mechanism, and the constituent element which ejects the pre-treatment liquid 40 arranged in the second region B (including the second region nozzles N[B]) functions as a second mechanism.

Modification Example

Each of the embodiments illustrated above may be variously modified, for example, may be combined appropriately in a range not inconsistent with each other. In addition, the following examples may be combined with each of the embodiments.

(1) The structure of the liquid ejecting head 36 is appropriately changed. For example, in each of the embodiments described above, the piezoelectric liquid ejecting head 36 using a piezoelectric element which applies mechanical vibration to a pressure chamber was exemplified; however, it is also possible to adopt a thermal liquid ejecting head using a heat generating element which generates bubbles in the interior of the pressure chamber by heating. In addition, the configuration of the plurality of nozzles N in the liquid ejecting head 36 is not limited to the examples of each of the embodiments described above. For example, the pre-treatment liquid 40 nozzle rows and the ink nozzle rows may be formed separately. In addition, in each of the embodiments described above, a case where two of the pre-treatment liquids 40 are landed and overlapped on a medium was described; however, without being limited thereto, three or more of the pre-treatment liquids 40 may be landed and overlapped.

(2) In each of the embodiments described above, a case where the liquid ejecting head 36 functions as a pre-treatment liquid coating mechanism which coats the pre-treatment liquid 40 on the medium 22 was described; however, without being limited thereto, the pre-treatment liquid coating mechanism may be provided separately to the liquid ejecting head 36. In such a case, the pre-treatment liquid coating mechanism may be formed by a spray mechanism which coats the pre-treatment liquid 40 on the medium 22 by spraying. For example, in the liquid ejecting head 36 in FIG. 18, the portion of the nozzle rows LP1 to LP4 in the second region B may be formed by a spray mechanism separate to the liquid ejecting head 36.

(3) In each of the embodiments described above, further it is possible to adjust the ejecting amount of the first pre-treatment liquid 40*a* and 40*a*' and the second pre-treatment liquid 40*b* and 40*b*'. For example, in the case of the medium 22 where liquid is almost not absorbed, it is possible to land the small dots of the pre-treatment with high permeability on the medium 22 to overlap small dots of the second pre-treatment liquid with low permeability or to land the large dots of the pre-treatment liquid with high permeability on the medium 22. In addition, for example, in the case of the medium 22 where liquid is hardly absorbed, it is possible to land the large dots of the pre-treatment liquid with high permeability on the medium 22 to overlap the small dots of the pre-treatment liquid with low permeability. In addition, for example, in the case of the medium 22 where liquid is absorbed a little, it is possible to land the large dots of the pre-treatment liquid with low permeability on the medium 22 to overlap small dots of the pre-treatment liquid with high permeability. In addition, for example, in the case of the medium 22 where liquid is sufficiently absorbed, it is possible to land the large dots of the pre-treatment with low permeability on the medium 22 to overlap large dots of the pre-treatment with high permeability.

That is, as the medium has high permeability, the time difference between the pre-treatment landing and the ink landing become short, and it is possible to further improve the printing quality by increasing the ejecting amount of the pre-treatment liquid and selecting the order of the ejecting pre-treatment liquid. In addition, as the medium has low permeability, the time difference between the pre-treatment landing and the ink landing become longer, and it is possible to further improve the printing quality by decreasing the ejecting amount of the pre-treatment liquid and selecting the order of ejecting the pre-treatment liquid.

(4) The liquid ejecting apparatus exemplified in each of the embodiments described above may be employed in various devices such as a facsimile apparatus or copier in addition to devices that are dedicated to printing. However, the application of the liquid ejecting apparatus of the invention is not limited to printing. For example, liquid ejecting apparatuses which eject a solution of a coloring agent are used as manufacturing apparatuses which form color filters for liquid crystal display apparatuses. In addition, liquid ejecting apparatuses which eject a solution of a conductive material are used as manufacturing apparatuses which form the wiring or an electrode of a wiring substrate.

REFERENCE SIGNS LIST

10 liquid ejecting apparatus, 22 medium, 22*a* medium with high liquid absorbency, 22*b* medium with low liquid absorbency, 24 liquid container, 30 control unit, 301 ROM, 302 RAM, 303 determination unit, 32 transport mechanism, 322 supply roller, 324 discharge roller, 34 movement mechanism, 342 carriage, 344 conveyor belt, 36 liquid ejecting head, 360 ejection surface, 37 medium sensor, 40 pre-treatment liquid, 40*a* first pre-treatment liquid, 40*a*' pre-treatment liquid with low permeability, 40*b* second pre-treatment liquid, 40*b*' pre-treatment liquid with high permeability, 41 ink, 71 flow path substrate, 712 opening, 714 branch flow path, 716 communication flow path, 72 pressure chamber substrate, 722 opening, 722 each opening, vibration plate, 74 piezoelectric element, 75 support, 754 introduction flow path, 76 nozzle plate, A first region, A1 region on the upstream side in the first region, A2 region on the downstream side in the first region, B second region, B1 region on the upstream side in the second region, B2 region on the downstream side in the second region, L0 nozzle row, LP LP1, LP2, LP3, LP4, LP1', LP2' pre-treatment liquid nozzle row, LI1, LI2, LI3, LI4 ink nozzle row, N[A] first region nozzle, N[B] second region nozzle, SC pressure chamber, SR common liquid chamber

The invention claimed is:

1. A liquid ejecting apparatus comprising:

a transport mechanism that transports a medium in a first direction;

a liquid ejection head that is provided with a pre-treatment liquid coating mechanism that coats the medium with a pre-treatment liquid and a liquid ejecting unit that includes a plurality of ink nozzles that eject ink; and a control unit that controls the pre-treatment liquid coating mechanism and the liquid ejecting unit, wherein the liquid ejection head has a first region and a second region that is positioned on an upstream side of the first region in the first direction, wherein the pre-treatment liquid coating mechanism is disposed in both the first region and the second region of the liquid ejection head, wherein the pre-treatment liquid coating mechanism includes a first mechanism that is disposed in the first region and a second mechanism that is disposed in the second region, and wherein the plurality of ink nozzles of the liquid ejection unit are disposed in the first region of the liquid ejection head and overlap with respect to the first mechanism in a second direction, and the plurality of ink nozzles do not overlap with respect to the second mechanism in the second direction, wherein the second direction intersects with the first direction.

2. The liquid ejecting apparatus according to claim 1, further comprising:

a determination unit for determining a type of the medium, wherein the control unit selects either the first mechanism or the second mechanism according to the type of the medium determined by the determination unit, and the selected mechanism coats the medium with the pre-treatment liquid.

3. The liquid ejecting apparatus according to claim 2, wherein the first region is further divided into an upstream side region and a downstream side region in the first direction, the plurality of ink nozzles is respectively disposed in the upstream side region and the downstream side region in the first region, the first mechanism is respectively disposed in the upstream side region and the downstream side region in the first region, and the control unit selects either the ink nozzles in the upstream side region in the first region or the ink nozzles in the downstream side region in the first region according to the type of the medium determined by the determination unit, and ejects the ink from the selected ink nozzles.

4. The liquid ejecting apparatus according to claim 2, wherein the second region is further divided into an upstream side region and a downstream side region in the first direction, the second mechanism is respectively disposed in the upstream side region and the downstream side region in the second region, and in a case of selecting the second mechanism, the control unit further selects either one or both of the second mechanism in the upstream side region or the second mechanism in the downstream side region in the second region, and ejects the pre-treatment liquid from the selected mechanism.

5. The liquid ejecting apparatus according to claim 1, wherein the pre-treatment liquid includes a first pre-treatment liquid and a second pre-treatment liquid that is a different type than the first pre-treatment liquid, the first mechanism includes a nozzle that ejects the first pre-treatment liquid, the second mechanism includes a nozzle that ejects the second pre-treatment liquid.

6. The liquid ejecting apparatus according to claim 1, further comprising:

a movement mechanism that reciprocates the liquid ejecting head in the second direction, wherein the liquid ejecting head is provided with plurality of nozzle rows that are arrayed at intervals to each other in the second direction, each of the plurality of the nozzle rows has a plurality of nozzles that are arranged from the first region to the second region, in one nozzle row out of the plurality of the nozzle rows, the plurality of the nozzles that are arranged in the first region are used as the first mechanism and the plurality of the nozzles that are arranged in the second region are used as the second mechanism, and in other nozzle rows out of the plurality of the nozzle rows, the plurality of the nozzles that are arranged in the first region are used as the plurality of the ink nozzles.

7. The liquid ejecting apparatus according to claim 1, further comprising:

a movement mechanism that reciprocates the liquid ejecting head in the second direction, wherein the pre-treatment liquid includes a first pre-treatment liquid and a second pre-treatment liquid that has higher permeation than the first pre-treatment liquid, the first mechanism includes two nozzle rows that are arrayed at intervals to each other in the second direction, and one of the nozzle rows is formed of nozzles that eject the first pre-treatment liquid and the other nozzle row is formed of nozzles that eject the second pre-treatment liquid, the nozzles of the first mechanism that eject the first pre-treatment liquid and the nozzles that eject the second pre-treatment liquid are overlapped with each other in plan view in the second direction, the second mechanism includes two nozzle rows that are arrayed at intervals to each other in the second direction, and one of the nozzle rows is formed of nozzles that eject the first pre-treatment liquid and the other nozzle row is formed of nozzles that eject the second pre-treatment liquid, and the nozzles of the second mechanism that eject the first pre-treatment liquid and the nozzles that eject the second pre-treatment liquid are overlapped with each other in plan view in the second direction.

8. The liquid ejecting apparatus according to claim 7, wherein the two nozzle rows in the first mechanism are arranged in order of the nozzle row of nozzles that eject the second pre-treatment liquid and the nozzle row of nozzles that eject the first pre-treatment liquid in the moving direction of the liquid ejecting head, and the two nozzle rows in the second mechanism are arranged in the order of the nozzle row of nozzles that eject the first pre-treatment liquid and the nozzle row of nozzles that eject the second pre-treatment liquid in the moving direction of the liquid ejecting head.

9. The liquid ejecting apparatus according to claim 1, wherein the liquid ejecting head is a long line head in the second direction, which intersects with the first direction.

10. A liquid ejecting method for a liquid ejecting apparatus, which coats a pre-treatment liquid on a medium and then lands ink on the medium, wherein:

the liquid ejecting apparatus includes a transport mechanism that transports the medium in a first direction, and a liquid ejection head that is provided with a pre-treatment liquid coating mechanism for coating the pre-treatment liquid on the medium and a liquid ejecting unit that includes a plurality of ink nozzles that eject ink, wherein the liquid ejection head has a first region and a second region that is positioned on an upstream side of the first region in the first direction, the pre-treatment liquid coating mechanism is disposed in both the first region and the second region of the liquid ejection head, and the pre-treatment liquid coating mechanism includes a first mechanism that is disposed in the first region and a second mechanism that is disposed in the second region, the plurality of ink nozzles of the liquid ejection unit is disposed in the first region of the liquid ejection head and is formed to overlap in a second direction crossing the first direction with respect to the first mechanism, and the plurality of ink nozzles is formed not to overlap in the second direction with respect to the second mechanism, and the liquid ejecting method comprising:

determining a type of the medium;

selecting either the first mechanism or the second mechanism according to the determined type of the medium; and coating the medium with the pre-treatment liquid using the selected mechanism.

* * * * *